US010700405B2

(12) United States Patent
Hollenbeck et al.

(10) Patent No.: US 10,700,405 B2
(45) Date of Patent: Jun. 30, 2020

(54) INTEGRATED WAVEGUIDE MONOPULSE COMPARATOR ASSEMBLY

(71) Applicant: Optisys, LLC, West Jordan, UT (US)

(72) Inventors: Michael C. Hollenbeck, West Jordan, UT (US); Robert Smith, West Jordan, UT (US); Clinton Cathey, West Jordan, UT (US); Janos Opra, West Jordan, UT (US)

( * ) Notice: Subject to any disclaimer, the term of this patent is extended or adjusted under 35 U.S.C. 154(b) by 2 days.

(21) Appl. No.: 16/028,134

(22) Filed: Jul. 5, 2018

(65) Prior Publication Data

US 2019/0140338 A1 May 9, 2019

Related U.S. Application Data

(60) Provisional application No. 62/528,519, filed on Jul. 4, 2017.

(51) Int. Cl.

| | |
|---|---|
| ***H01P 5/20*** | (2006.01) |
| ***H01P 3/12*** | (2006.01) |
| ***H01P 1/02*** | (2006.01) |
| ***H01Q 21/00*** | (2006.01) |

(52) U.S. Cl.

CPC ..... *H01P 5/20* (2013.01); *H01P 1/025* (2013.01); *H01P 1/027* (2013.01); *H01P 3/12* (2013.01); *H01Q 21/0006* (2013.01)

(58) Field of Classification Search

CPC .... H01P 5/20; H01P 3/12; H01P 1/027; H01P 1/025; H01P 1/122; H01P 1/12; H01Q 21/0006

USPC ..... 333/106, 108, 254, 256, 258, 259

See application file for complete search history.

(56) References Cited

U.S. PATENT DOCUMENTS

| | | | |
|---|---|---|---|
| 2,582,162 | A | 2/1952 | Sensiper et al. |
| 5,859,619 | A | 1/1999 | Wu et al. |
| 6,911,953 | B2 | 6/2005 | Gothard et al. |
| 6,937,201 | B2 | 8/2005 | Gothard et al. |
| 7,187,340 | B2 | 3/2007 | Kralovec et al. |
| 9,318,810 | B2 | 4/2016 | Zelenski |
| 2013/0314172 | A1 | 11/2013 | Massman |

(Continued)

FOREIGN PATENT DOCUMENTS

| | | | |
|---|---|---|---|
| CN | 103961946 | A | 4/2014 |
| DE | 4002522 | A1 | 8/1991 |

OTHER PUBLICATIONS

F.I. Sheftman, "Experimental Study of Subreflector Support Structures in a Cassegrainian Antenna", Technical Report 416, Sep. 23, 1966, Lincoln Laboratory, Massachusetts Institute of Technology, Lexington, MA.

*Primary Examiner* — Rakesh B Patel
*Assistant Examiner* — Jorge L Salazar, Jr.
(74) *Attorney, Agent, or Firm* — Paul C. Oestreich; Eminent IP, P.C.

(57) ABSTRACT

Embodiments of the invention include an integrated monopulse comparator assembly for use in tracking antenna applications such as an antenna feed or an antenna array. Embodiments of the monopulse comparator assembly may include four rectangular waveguide antenna inputs, four magic tees, rectangular waveguide connections, and four rectangular waveguide monopulse outputs. An embodiment of a 4×4 antenna array including an embodiment of an integrated monopulse comparator assembly is also disclosed.

19 Claims, 23 Drawing Sheets
(21 of 23 Drawing Sheet(s) Filed in Color)

(56) References Cited

U.S. PATENT DOCUMENTS

| | | | | |
|---|---|---|---|---|
| 2015/0091769 | A1 | 4/2015 | Zelenski et al. | |
| 2015/0207201 | A1* | 7/2015 | Kohl | H01P 1/161<br>333/254 |

* cited by examiner

INTEGRATED WAVEGUIDE MONOPULSE COMPARATOR ASSEMBLY

CROSS-REFERENCE TO RELATED APPLICATIONS

This US non-provisional patent application claims benefit and priority to U.S. provisional patent application No. 62/528,519 filed on Jul. 4, 2017, titled "INTEGRATED WAVEGUIDE MONOPULSE COMPARATOR ASSEMBLY", the contents of which are incorporated by reference as if fully set forth herein for all purposes.

This US non-provisional patent application is related to international patent application No. PCT/US2017/056805, filed on Oct. 16, 2017, titled "INTEGRATED SINGLE-PIECE ANTENNA FEED AND CIRCULAR POLARIZER", expired. This US non-provisional patent application is also related to US continuation-in-part patent application Ser. No. 15/968,463, filed, May 1, 2018, titled "INTEGRATED SINGLE-PIECE ANTENNA FEED AND COMPONENTS", published, Oct. 11, 2018, as US Patent Application Publication No. US 2018/0294573 an issued, Nov. 15, 2019, as U.S. Pat. No. 10,468,773, which claims benefit and priority to U.S. continuation patent application Ser. No. 15/679,137, filed on Aug. 16, 2017, titled: INTEGRATED SINGLE-PIECE ANTENNA FEED AND CIRCULAR POLARIZER, issued as U.S. Pat. No. 9,960,495 on May 1, 2018, which in turn claims benefit and priority to U.S. non-provisional patent application Ser. No. 15/445,866, filed on Feb. 28, 2017, titled "INTEGRATED SINGLE-PIECE ANTENNA FEED", issued as U.S. Pat. No. 9,742,069 on Aug. 22, 2017, which in turn claims benefit and priority to U.S. provisional patent application No. 62/409,277 filed on Oct. 17, 2016, titled "INTEGRATED SINGLE-PIECE ANTENNA FEED", now expired. The contents of all of the above-referenced patent applications are incorporated by reference as if fully set forth herein for all purposes.

BACKGROUND OF THE INVENTION

Field of the Invention

The present invention relates generally to antennas and tracking methods for antennas. In particular, this invention relates to monopulse tracking for use in microwave antenna systems using a waveguide monopulse comparator assembly.

Description of Related Art

High gain antennas, used in applications such as microwave antenna systems for communications and radar, have narrow beamwidths that must point to and track a target with high accuracy. This tracking can be achieved through methods such as step tracking, conical scan tracking, or monopulse tracking.

Conventional manufacturing methods for fabricating waveguide monopulse comparator assemblies (used for monopulse tracking) generally require fabrication, assembly, tuning, and testing of multiple individual components. This process requires that the monopulse comparator assembly subcomponents be sized larger than necessary, with respect to performance, in order to facilitate assembly, tune, and test. This further leads to a completed monopulse waveguide comparator assembly that is physically larger, heavier, and has higher RF insertion loss than is necessary, with respect to the minimum size, weight, and performance allowed by the critical waveguide geometries.

Accordingly, there exists a need in the art for an integrated monopulse comparator assembly fabricated as a single part or as a subcomponent in a larger single part that minimizes size and weight, improves RF performance, and that does not require assembly or tuning.

BRIEF SUMMARY OF THE INVENTION

Embodiments of the invention include an integrated monopulse comparator assembly for use in tracking antenna applications such as an antenna feed or an antenna array. Embodiments of the monopulse comparator assembly may include four rectangular waveguide antenna inputs, four magic tees, rectangular waveguide connections, and four rectangular waveguide monopulse outputs. The four magic tees may be oriented in such a way to minimize both the total rectangular waveguide routing length and also the total physical size of the monopulse, according to other embodiments.

An embodiment of a waveguide magic tee enclosing an internal chamber is disclosed. The embodiment of a magic tee may include a top, a back, a front, a first side, a second side and a plane of symmetry dividing the first side from the second side. The embodiment of a magic tee may further include a first side input branch air volume extending from the plane of symmetry to the first side and having a rectangular first side port. The embodiment of a magic tee may further include a second side input branch air volume extending from the plane of symmetry to the second side and having a rectangular second side port. The embodiment of a magic tee may further include an output combined branch air volume extending from the first and second side input branches to the front and having a rectangular combined port. The embodiment of a magic tee may further include an expansion prism air volume extending from the first and second side input branches toward the top. The embodiment of a magic tee may further include an output difference branch air volume extending from the expansion prism air volume to the top and having a rectangular difference port.

An embodiment of an integrated waveguide monopulse comparator assembly is disclosed. The embodiment of an integrated waveguide monopulse comparator may include first, second, third and fourth magic tees, wherein each of the four magic tees may have the structure and features as described in the previous paragraph. The embodiment of an integrated waveguide monopulse comparator may further include the rectangular difference port of the first magic tee being coupled to the first side port of the fourth magic tee. The embodiment of an integrated waveguide monopulse comparator may further include the rectangular difference port of the second magic tee coupled to the second side port of the fourth magic tee. The embodiment of an integrated waveguide monopulse comparator may further include the rectangular combined port of the first magic tee coupled to the second side port of the third magic tee. The embodiment of an integrated waveguide monopulse comparator may further include the rectangular combined port of the second magic tee coupled to the first side port of the third magic tee.

An embodiment of a 4×4 antenna array is disclosed. The embodiment of a 4×4 antenna array may include four magic tees, each of the magic tees may be configured with the structure and features described above. The embodiment of a 4×4 antenna array may further include an integrated waveguide monopulse comparator assembly comprising the four magic tees, namely the first, second, third and fourth magic tees. The embodiment of a 4×4 antenna array may further include the rectangular difference port of the first magic tee being coupled to the first side port of the fourth magic tee. The embodiment of a 4×4 antenna array may further include the rectangular difference port of the second magic tee being coupled to the second side port of the fourth magic tee. The embodiment of a 4×4 antenna array may further include the rectangular combined port of the first magic tee being coupled to the second side port of the third magic tee. The embodiment of a 4×4 antenna array may further include the rectangular combined port of the second magic tee being coupled to the first side port of the third magic tee.

Additional features and advantages of the invention will be apparent from the detailed description which follows, taken in conjunction with the accompanying drawings, which together illustrate, by way of example, features of embodiments of the present invention.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

The following drawings illustrate exemplary embodiments for carrying out the invention. Like reference numerals refer to like parts in different views or embodiments of the present invention in the drawings.

DETAILED DESCRIPTION OF THE INVENTION

Figure 1A:
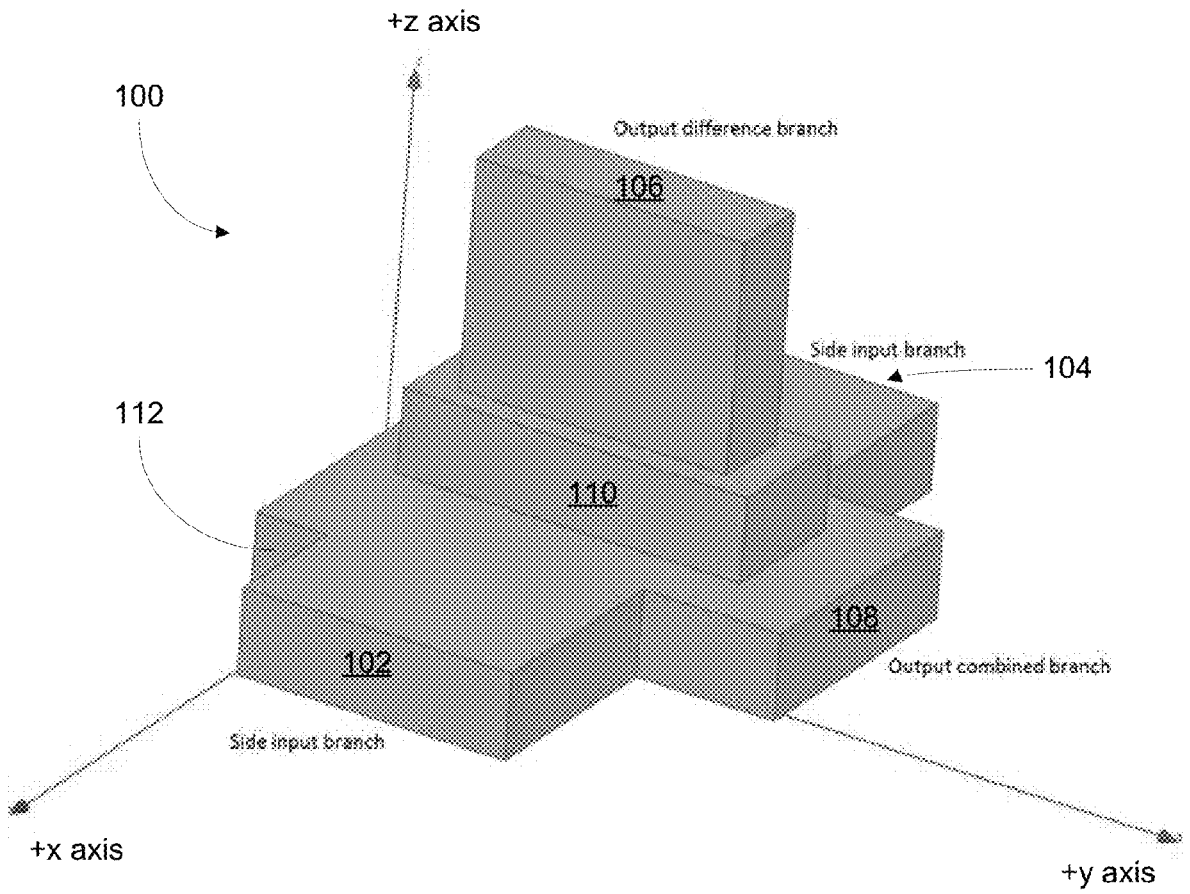
FIG. 1A illustrates a labeled isometric view of an embodiment of a magic tee with output difference branch pointing in the +z axis, output combined branch in +y axis, and side input branches in +/−x axis, according to the present invention.

Embodiments of the present invention include an integrated waveguide monopulse comparator assembly for use in antenna feeds and arrays utilized in communications and radar systems such as SATCOM, long range line of-sight (LOS) communications links, and radar. One embodiment of the integrated waveguide monopulse comparator assembly may include four rectangular waveguide antenna inputs, four waveguide magic tees, four routing rectangular waveguide connections, and four rectangular waveguide monopulse outputs as a single part metal component. This integrated waveguide monopulse comparator assembly may be used in conjunction with an antenna feed and main reflector in a dish antenna system, or it may be used with an antenna array, according to various system embodiments. Integrated embodiments and individual components of the invention described herein may be manufactured using three-dimensional (3D) metal printing techniques.

The terms "pointing" and "facing" are used interchangeably herein to describe waveguide port orientation relative to an axial direction. For example, by saying the "fourth rectangular waveguide monopulse output 418 facing in the +y axis direction" means that a perpendicular vector emanating from the face of output 418 would be parallel to the +y axis and pointing toward the +y axis direction. With regard to the waveguides and their counterpart air volumes described herein, the terms "input" and "output" refer to a port that may be configured to receive or send an electromagnetic wave. However, it will also be understood that "input" and "output" may be used interchangeable to describe any port and are only used when describing a specific direction for the flow of energy (typically flowing from input to output). Given the reciprocal nature of a waveguide, input and output may be swapped when the direction of energy is swapped. Thus, a port may act simultaneously as an input and an output. The term "prism" as used herein refers to a right prism, which is a 3D object with two parallel bases that are the same shape and parallel to each other, and two sets of opposed rectangular faces that are also parallel to each other. Moreover, the prisms as used herein are "right prisms" because where the bases and rectangular faces meet are perpendicular lines that meet at a 90°, or right, angle.

Monopulse tracking generally has both a hardware and software component. The hardware component for monopulse tracking can be achieved in a number of ways, for example: a waveguide $TE_{21}$ mode coupler, a waveguide monopulse comparator assembly, or in a printed circuit board (PCB) monopulse comparator assembly.

Waveguide $TE_{21}$ mode couplers can be designed with a complex assembly of coupling waveguides surrounding an overmoded circular waveguide. Waveguide monopulse comparator assemblies can be designed with the building blocks of 90° hybrid couplers with additional phase shifters, 180° couplers, magic tees, or a combination of these. PCB monopulse comparator assemblies can be designed with the building blocks of 90° hybrid couplers with additional phase shifters, 180° couplers, rat races, or a combination of these.

Figure 8:
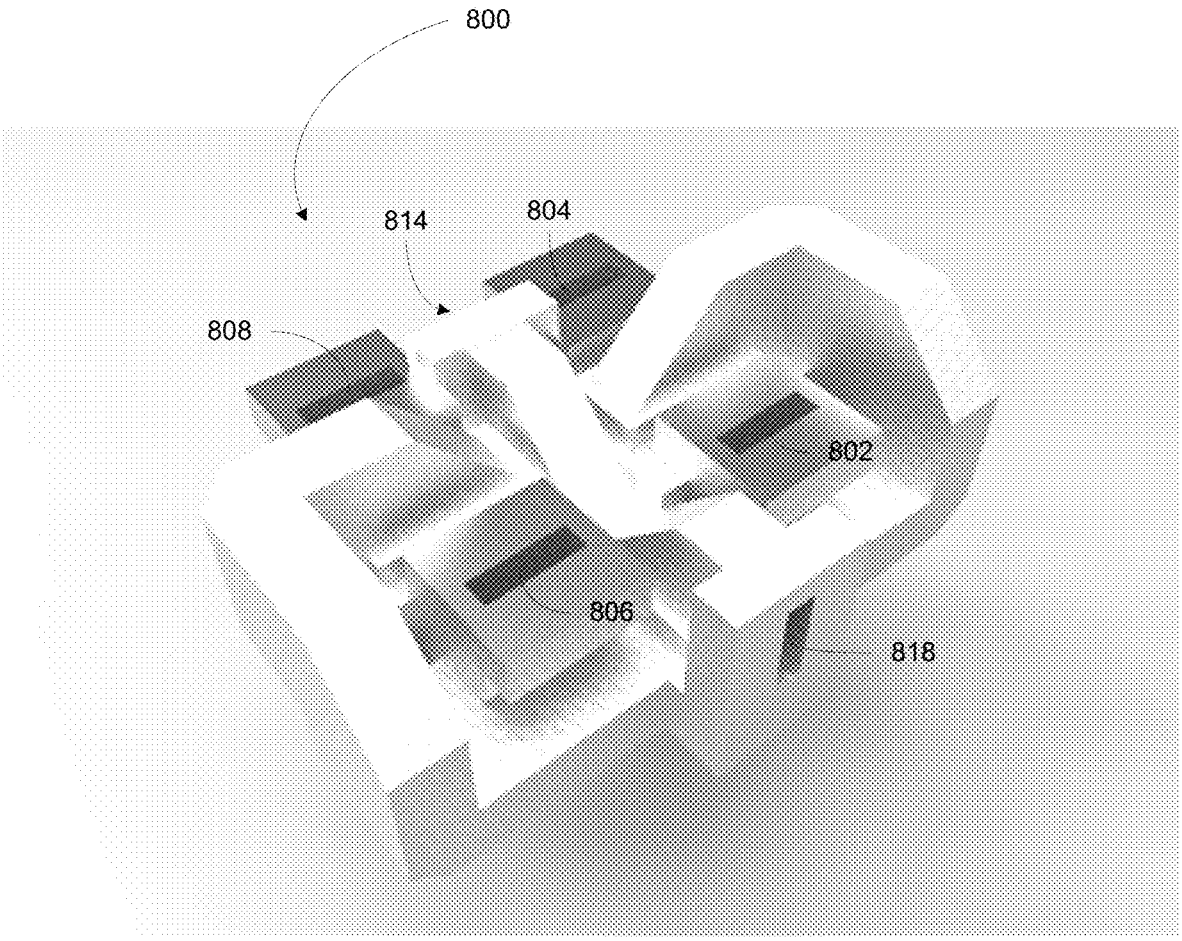
FIG. 8 is an isometric view of a sixth embodiment of an integrated monopulse comparator, according to the present invention.
Figure 9:
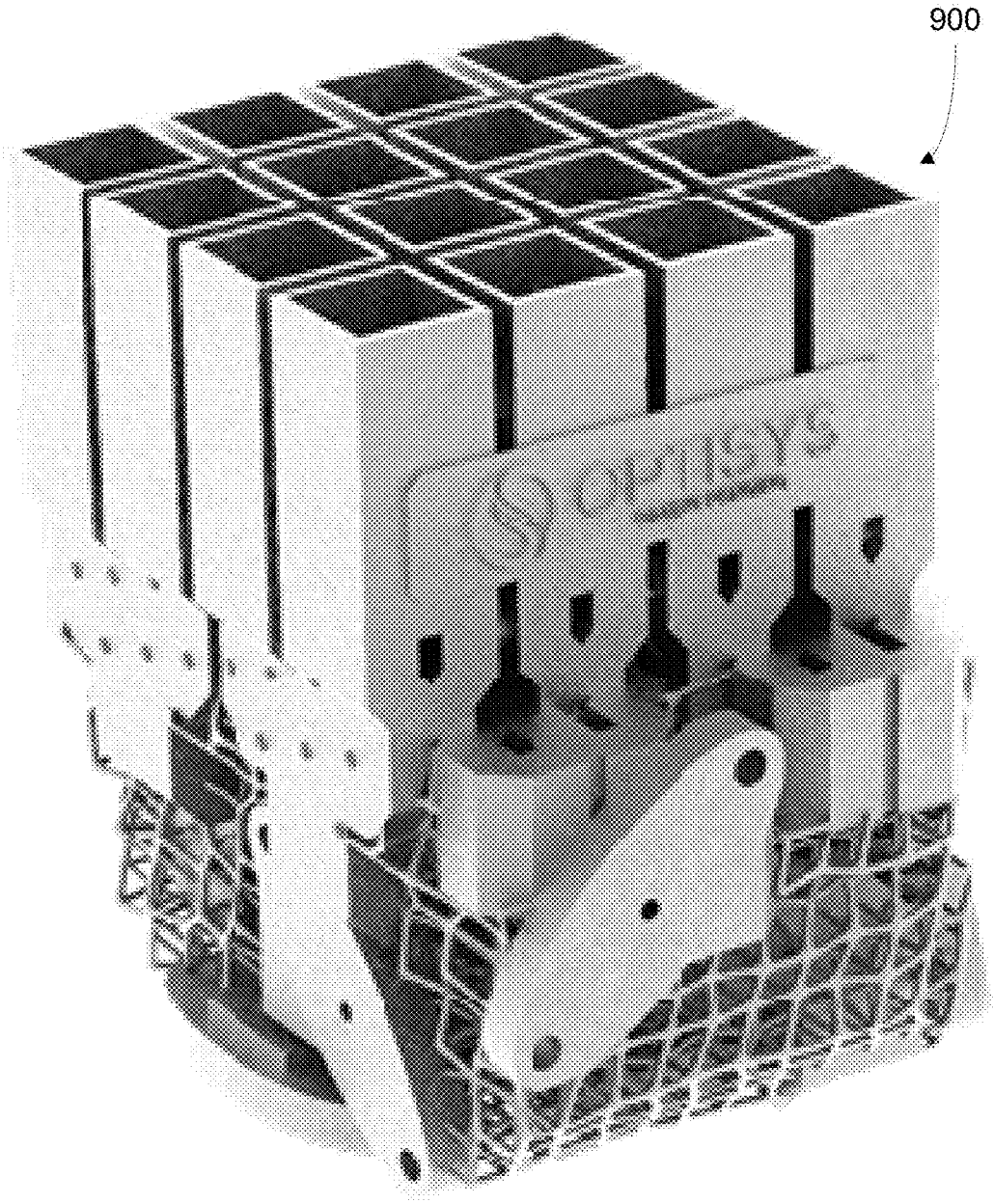
FIG. 9 is a perspective image of an embodiment of a 4×4 antenna array including an embodiment of an integrated monopulse comparator similar to first, fourth and sixth embodiments of a monopulse comparator as described herein, that has been integrated into the lower quarter of the antenna array design, according to the present invention.

Further detailed description will now be made with reference to the drawing FIGS. and specific embodiments of the present invention. Note that FIGS. 1-7 represent air volumes within waveguide structures. Whereas FIGS. 8 and 9 illustrate metal waveguide structures enclosing air volumes through which electromagnetic waves are processed and propagated.

Figure 1B:
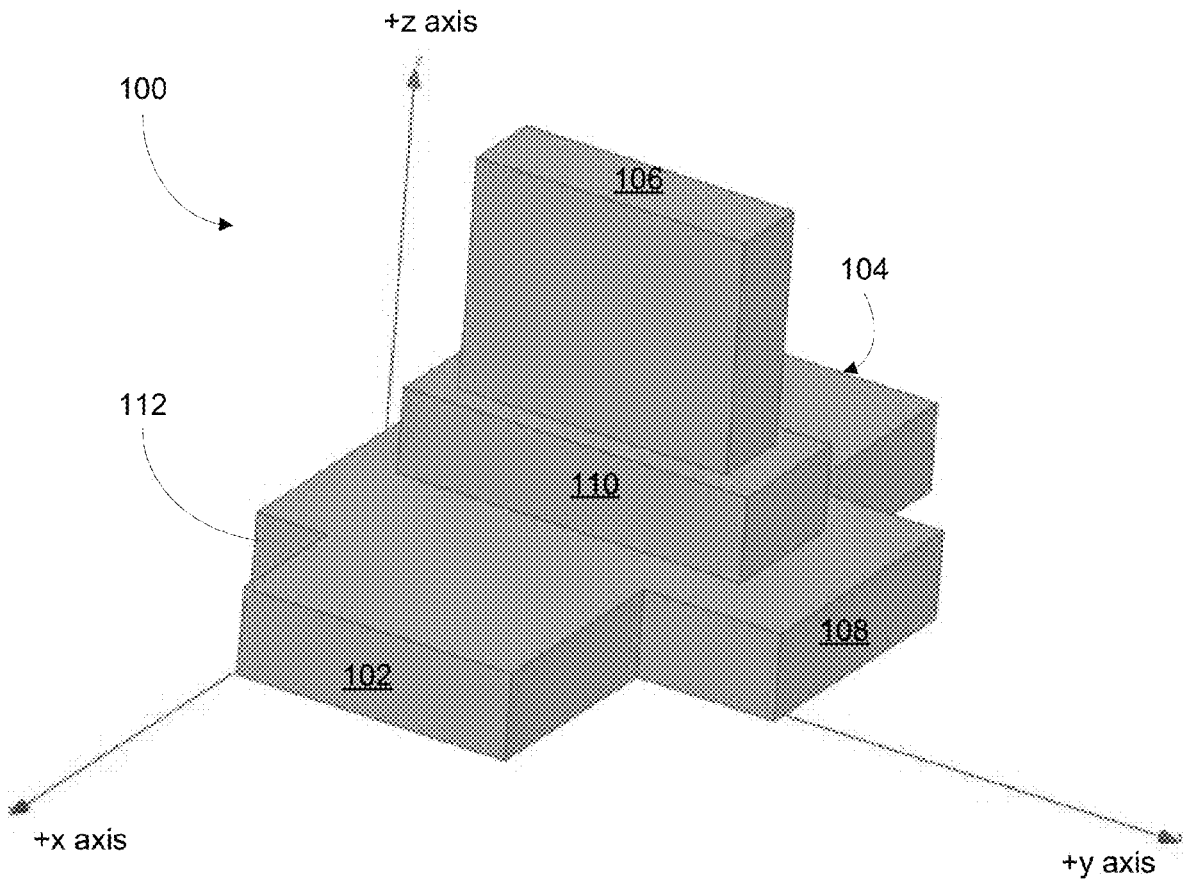
FIG. 1B illustrates an isometric view without labels of the embodiment of a magic tee shown in FIG. 1A with output difference branch pointing in the +z axis, output combined branch in +y axis, and side input branches in +/−x axis, according to the present invention.

FIGS. 1A and 1B, labeled and unlabeled, respectively, illustrate isometric perspective views of an air volume of an embodiment of a magic tee 100, according to the present invention. As shown in FIGS. 1A and 1B, magic tee 100 may include a first side input branch 102 oriented parallel to the +x axis. Magic tee 100 may further include a second side input branch 104 oriented parallel to the −x axis (not labeled in FIG. 1A). Magic tee 100 may further include an output difference branch 106 oriented parallel to the +z axis. Magic tee 100 may further include an output combined branch 108 oriented parallel to the +y axis.

Branches 102, 104, 106 and 108 are generally right prism in shaped air volumes with rectangular ports, openings, or faces that extend in axial directions. For example, first 102 and second 104 side input branches extend with openings or faces from output combined branch 108 which has its own port. Additional features of magic tee 100 include additional air volumes, namely expansion prism 110 located between output difference branch 106 and output combined branch 108, and base expansion prism 112 adjacent to, and extending underneath, first 102 and second 104 side input branches as shown in FIGS. 1A and 1B. The various ports from the input 102 and 104 and output 106 and 108 branches lead to an internal chamber 116, not shown in FIGS. 1A and 1B, but see FIG. 1D.

Figure 1C:
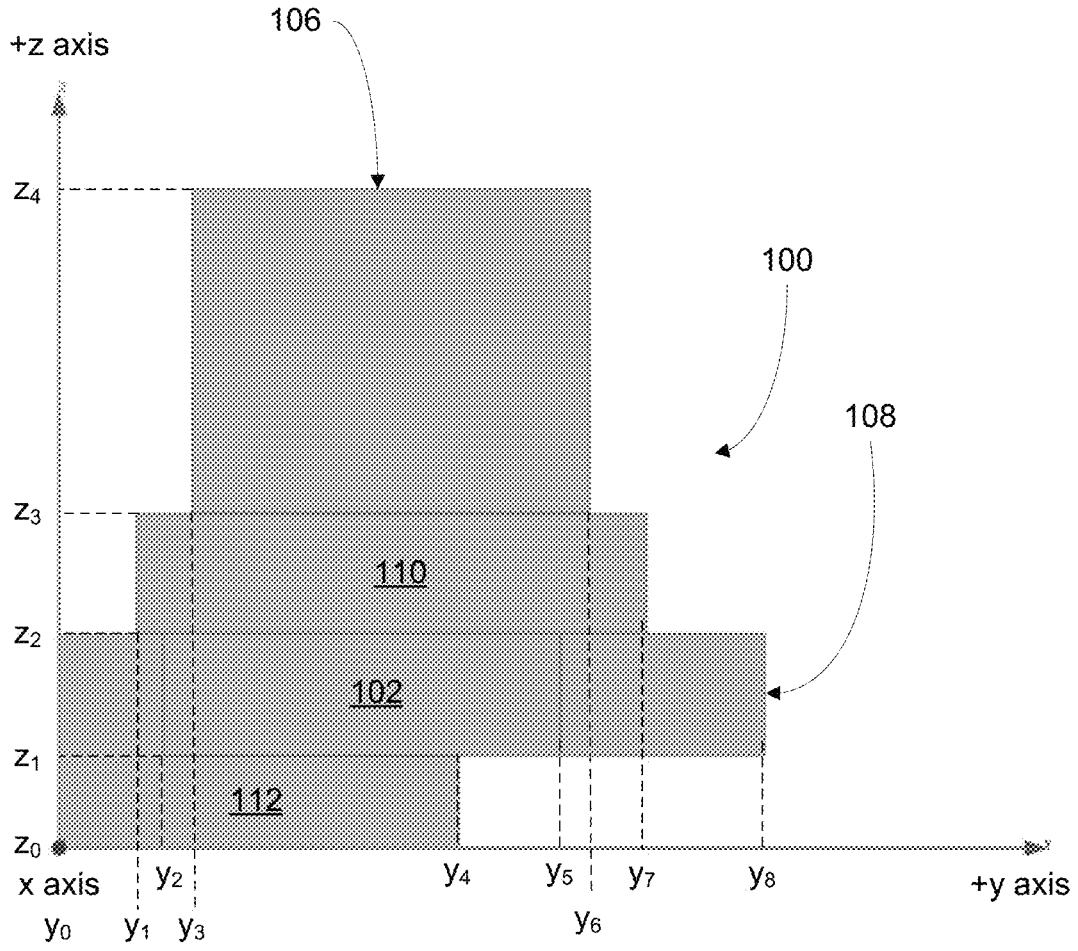
FIG. 1C illustrates another isometric view of the embodiment of a magic tee shown in FIGS. 1A and 1B, with output difference branch pointing in the +z axis, output combined branch in +y axis, and side input branches in +/−x axis (in and out of the viewing surface), according to the present invention.

FIG. 1C illustrates another isometric x axis view (lower left-hand corner dot) of the air volume of the embodiment of a magic tee 100 shown in FIGS. 1A and 1B, with output difference branch 106 pointing in the +z axis, output combined branch extending parallel to the +y axis, and side input branches in +/−x axis (in and out of the viewing surface, only first side input branch 102 visible in FIG. 1C), according to the present invention. FIG. 1C also illustrates expansion prism 110 located between output difference branch 106 and output combined branch 108. FIG. 1C further illustrates base expansion prism 112 located beneath first side input branch 102 and expansion prism 110. The expansion prisms 110 and 112 are believed to be novel in that it provides better match between all of the waveguides going into the cavity formed by the magic tee 100. Note that second side input branch port 106 is not shown in FIG. 1C, but is behind first side input branch 102.

As shown in FIG. 1C magic tee 100 has particular features with dimensions in the y and z axes relative to the origin shown as x axis. More particularly, base expansion prism 112 has an edge along the x axis ($y_0$, $z_0$) and expands in the +z axis direction from $z_0$ to $z_2$, and expands in the +y axis direction from $y_0$ to $y_4$. First side input branch 102 overlaps base expansion prism and extends from $z_1$ to $z_2$ in the +z axis direction and from y2 to y5 in the +y axis direction. Output combined branch 108 extends from first side input branch 102 from y5 to y8 in the +y axis direction. Expansion prism 110 is layered on top of base expansion prism 112, first side input branch 102 and output combined branch 108 and extends in the +y axis direction from $y_1$ to $y_7$ and in the +z direction from $z_2$ to $z_3$. Finally, output difference branch 106 is layered on top of expansion prism 110 and extends in the +y axis direction from $y_3$ to $y_0$ and in the +z direction from $z_3$ to $z_4$. As shown in FIG. 1C, $y_0<y_1<y_2<y_3<y_4<y_5<y_6<y_7<y_8$. Similarly, as shown in FIG. 1C $z_0<z_1<z_2<z_3<z_4$.

Figure 1D:
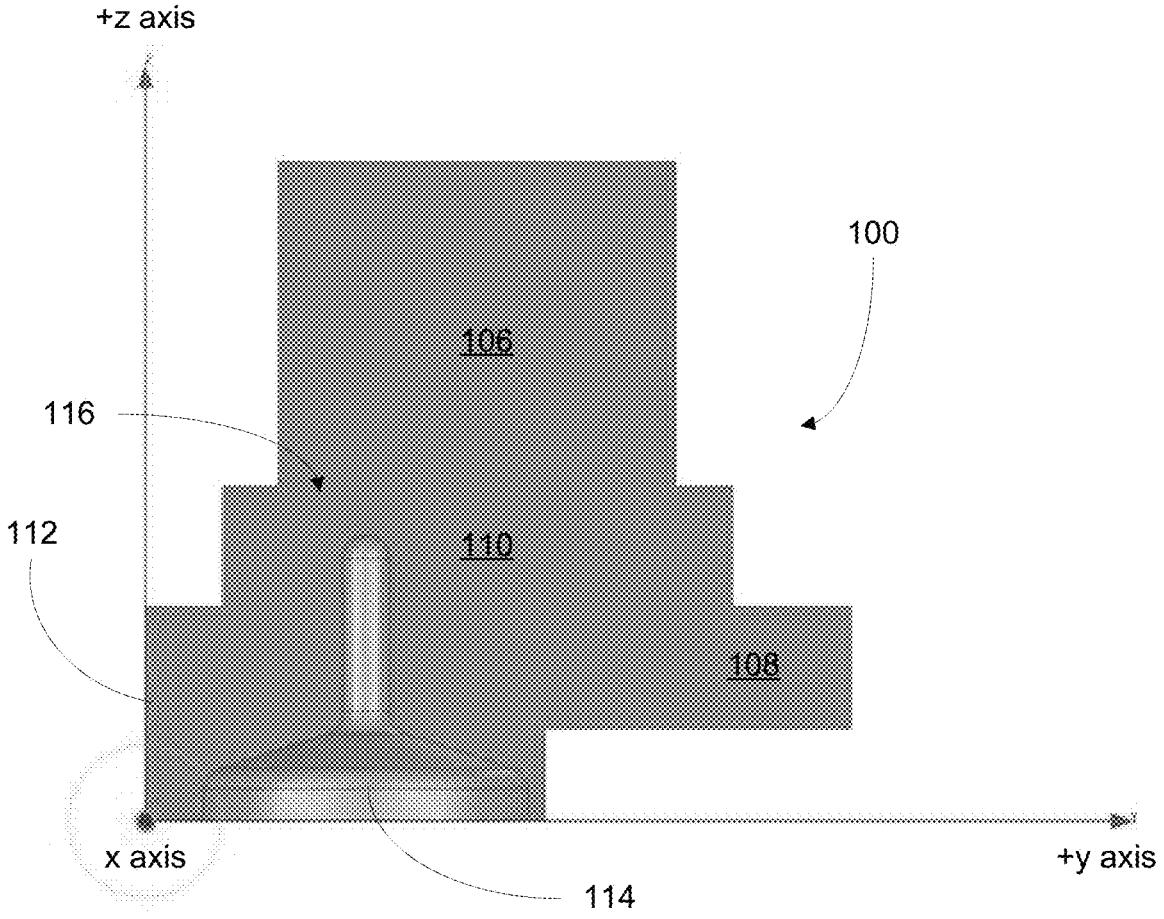
FIG. 1D is a cross-sectional side view of the embodiment of a magic tee shown in FIGS. 1A through 1C with y-z cut plane through center of the magic tee with output difference branch pointing in the +z axis, output combined branch in +y axis, and side input branches in +/−x axis, according to the present invention.

FIG. 1D illustrates a cross-sectional side view of the air volume of the embodiment of a magic tee 100 shown in FIGS. 1A through 1C with y-z cut plane through center of the magic tee 100. As shown in FIG. 1D, the output difference branch 106 extends parallel to the +z axis, according to the present invention. As further shown in FIG. 1D, output combined branch 108 extends parallel to the +y axis, according to the present invention. FIG. 1D further illustrates an internal matching structure 114 located within internal chamber, shown generally at arrow 116. Internal matching structure 114 is a metal structure (not an air volume) that allows for improved performance of the magic tee 100 over a wide bandwidth. Though internal matching structure 114 is shown having an inverted funnel shape with smooth edges, other matching structures (not shown) may have other shapes, for example and not by way of limitation, a series of cylinders with sharp corners.

Figure 1E:
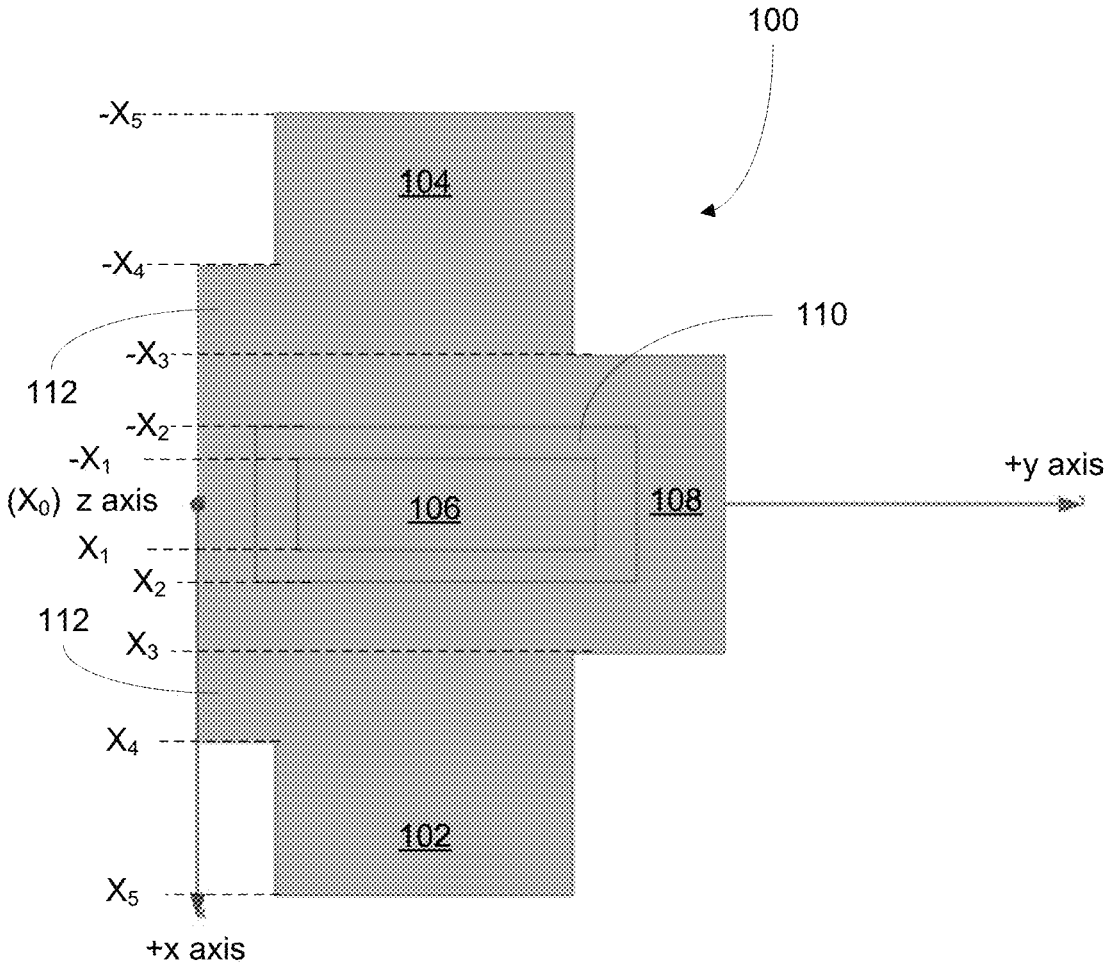
FIG. 1E is a top view of the embodiment of a magic tee shown in FIGS. 1A through 1D with output difference branch pointing in the +z axis, output combined branch in +y axis, and side input branches in +/−x axis, according to the present invention.

FIG. 1E illustrates a top view of the air volume of the embodiment of a magic tee 100 shown in FIGS. 1A through 1D. FIG. 1E illustrates output difference branch 106 as a central rectangle that extends parallel to the +z axis (illustrated as a dot on the left side of FIG. 1E), according to the present invention. FIG. 1E further illustrates output combined branch 108 extending parallel in to the +y axis, according to the present invention. FIG. 1E further illustrates side input branches 102 and 104 extending parallel to the +/−x axis, respectively, according to the present invention.

As further shown in FIG. 1E, magic tee 100 has specific features with dimensions in the +/−x axis directions and also in the +y axis directions. More particularly, base expansion prism 112 has an edge extending along the x axis from $-x_4$ to $x_4$. First side input branch 102 extends from the base expansion prism 112 from $x_4$ to $x_5$. First side input branch 102 also extends from the output combined branch 108 from $x_3$ to $x_5$. Second side input branch 104 extends from the base expansion prism 112 from $-x_4$ to $-x_5$. Second side input branch 104 also extends from the output combined branch 108 from $-x_3$ to $-x_5$. Expansion prism 110 falls between $-x_2$ and $x_2$. Finally, output difference branch falls between $-x_1$ and $x_1$. Note that $-x_5<-x_4<-x_3<-x_2<-x_1<x_0$ $(0)<x_1<x_2<x_3<x_4<x_5$.

Figure 1F:
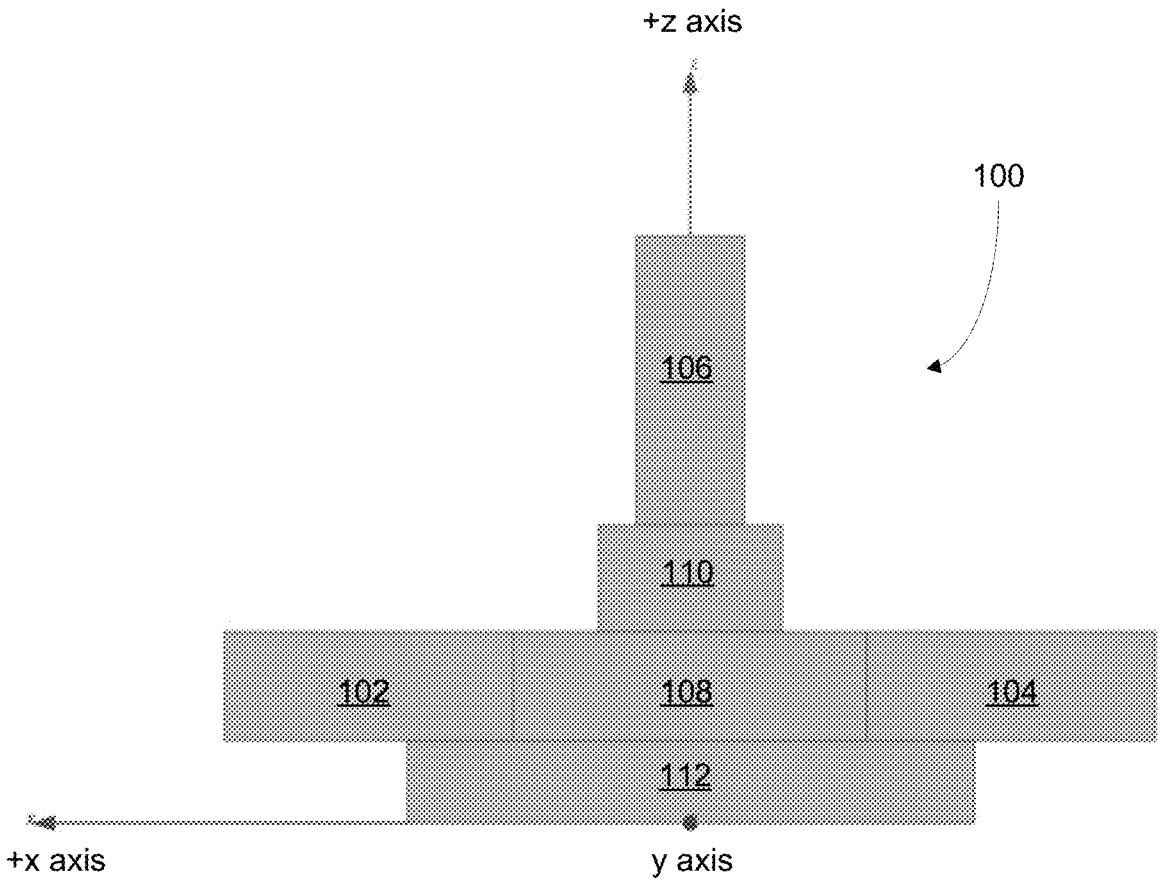
FIG. 1F is a front view of the embodiment of a magic tee shown in FIGS. 1A through 1E with output difference branch pointing in the +z axis, output combined branch in +y axis, and side input branches in +/−x axis, according to the present invention.

FIG. 1F illustrates a front view of the air volume of the embodiment of a magic tee shown in FIGS. 1A through 1E with output difference branch pointing in the +z axis, output combined branch in +y axis, and side input branches in +/−x axis, according to the present invention.

Note that input branches 102 and 104 are prism shaped air volumes that are generally enclosed except for ports, or faces, that act as inputs for electromagnetic waves entering magic tee 100. Similarly, output branches 106 and 108, are prism shaped air volumes that are generally enclosed except for ports, or faces, that act as outputs for electromagnetic waves leaving magic tee 100. As noted above, the designation of an input or output for a given port of a waveguide may be reversed if the electromagnetic energy is reversed. Finally, expansion prism 110 and base expansion prism 112 are generally prism-shaped air volumes that do not have external ports, but are open to adjacent air volumes 102, 104, 106 and 108 that form internal chamber 116 and surround internal matching structure 114. Thus, magic tee 100 is a 3-dimensional (3D) air volume with two input ports 102 and 104 and two output ports 106 and 108, enclosing an internal chamber 116 with internal matching structure 114 (not an air volume), that may combined with other waveguide structures to form other antenna components.

Figure 2:
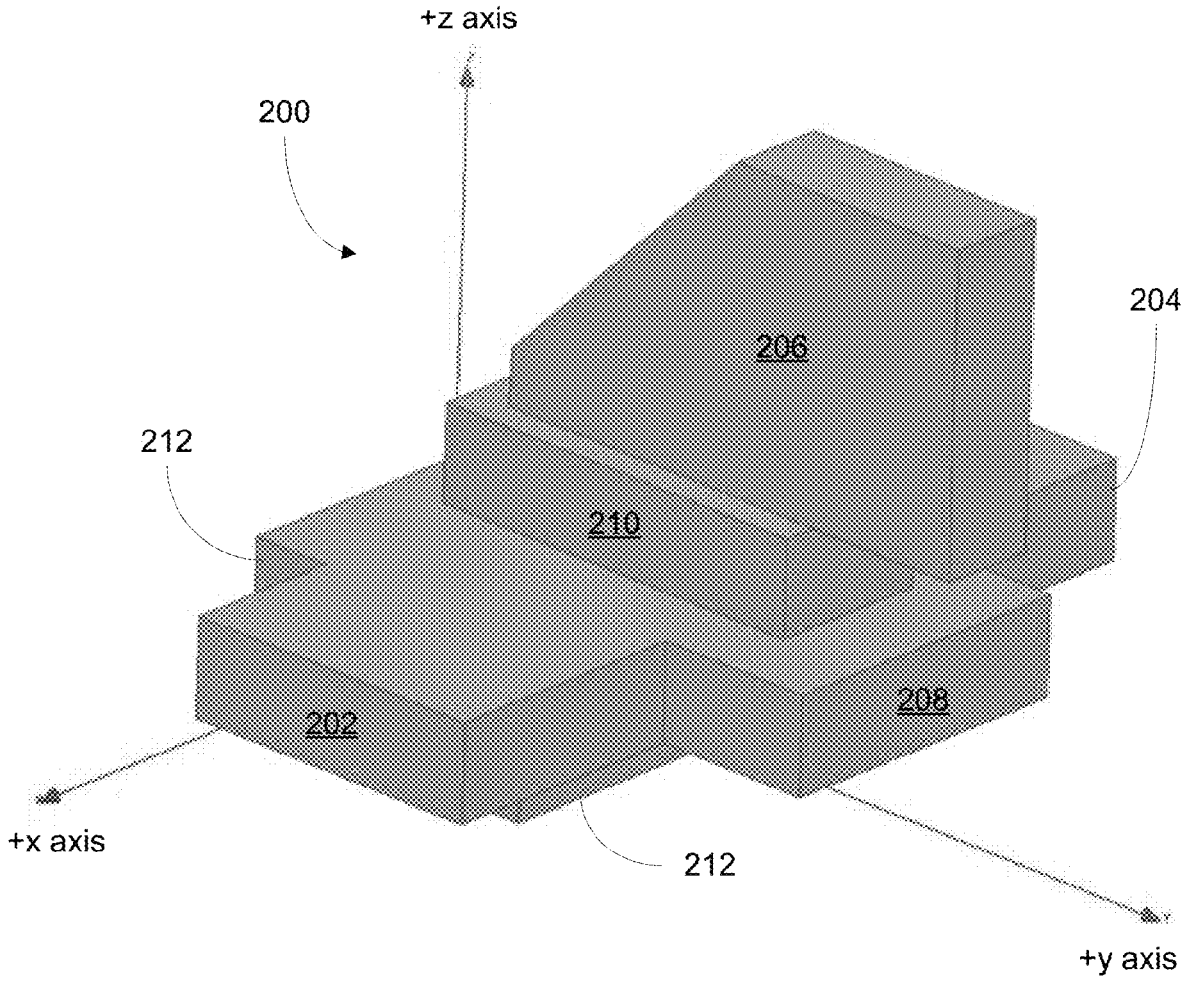
FIG. 2 is an isometric view of another embodiment of a magic tee with output difference branch pointing in the +y axis, output combined branch in +y axis, and side input branches in +/−x axis, according to the present invention.

FIG. 2 illustrates an isometric perspective view of the air volume of another embodiment of a magic tee 200. As shown in FIG. 2, the embodiment of magic tee 200 may include an output difference branch 206 extending parallel to the +y axis and +z axis. Output difference branch 206 has the shape of a 7-sided block configured to guide electromagnetic waves along the y axis and the z axis. The embodiment of magic tee 200 may further include output combined branch 208 extending parallel to the +y axis and underneath output difference branch 206. Output combined branch 208 has a generally prism-shaped air volume. Magic tee 200 may further include first 202 and second 204 and side input branches extending parallel to the +/−x axis, respectively, according to the present invention. First 202 and second 204 side input branches are also generally prism shaped air volumes. Magic tee 200 may further include expansion prism 210 sandwiched between output difference branch 206 and output combined branch 208. Magic tee 200 may further include base expansion prism 212 extending toward the −y and −z axis directions from first 202 and second 204 side input branches. The primary distinction between magic tee 100 and magic tee 200 is the shape of output difference branch 206.

Figure 3A:
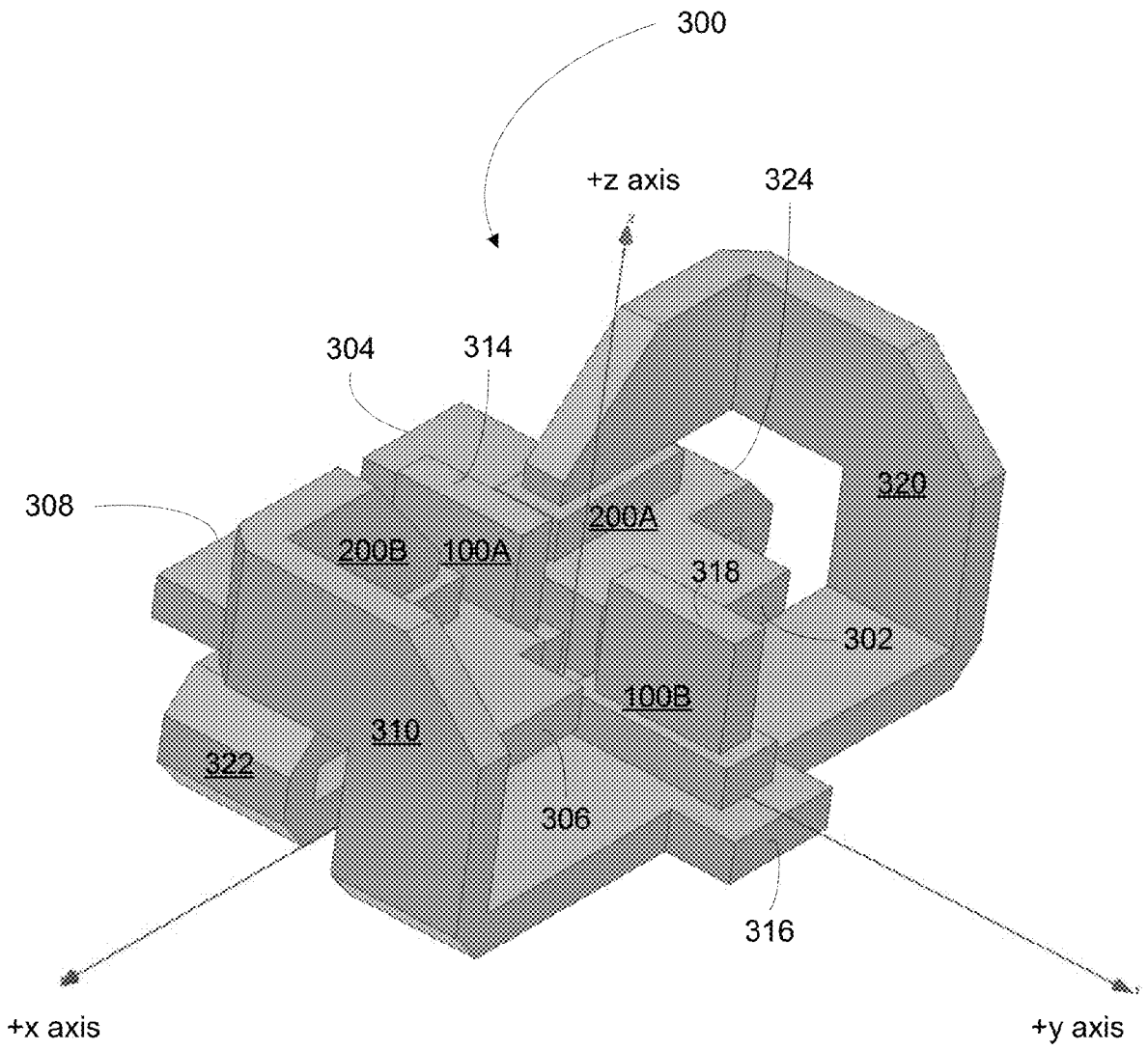
FIG. 3A is a labeled isometric view of a first embodiment of an integrated monopulse comparator configuration, according to the present invention.

FIG. 3A illustrates a labeled isometric perspective view of the air volume of a first embodiment of an integrated monopulse comparator 300, according to the present invention. Note that integrated monopulse comparator 300 is formed from two symmetrically oriented magic tees 100A and 100B and two symmetrically oriented magic tees 200A and 200B with some additional connective waveguide 310, 320, 330 and 340 to interconnect the magic tees 100A, 100B, 200A and 200B. Note that magic tees 100A and 100B generally have the air volume and internal structure shown for magic tee 100 as discussed above and shown in FIGS. 1A-1F. Similarly, magic tees 200A and 200B generally have the air volume and internal structure shown for magic tee 200 as discussed above and shown in FIG. 2.

More particularly, the monopulse comparator 300 shown in FIG. 3A may include two magic tees 100A and 100B shown adjacent to one another along the y axis. More particularly, magic tees 100A and 100B are oriented back to back symmetrically, but separated by a panel of metal (not visible in FIG. 3A, but see 326 in FIG. 3B). Monopulse comparator 300 further includes two magic tees 200A and 200B extending generally along the x axis and shifted in the +z axis direction and surrounding magic tee 100A. As with magic tees 100A and 100B, magic tees 200A and 200B are also oriented symmetrically with respect to one another.

As shown in FIG. 3A, integrated monopulse comparator 300 includes connective waveguide air volume 310 connecting the output difference branch 206 of magic tee 200B to first side input branch 102 of magic tee 100B. Symmetrically, integrated monopulse comparator 300 further includes connective waveguide air volume 320 connecting the output difference branch 206 of magic tee 200A to second side input branch 104 of magic tee 100B. Integrated monopulse comparator 300 further includes connective waveguide air volume 322 connecting output combined branch 208 of magic tee 200B to second side input branch 104 of magic tee 100A. Symmetrically, integrated monopulse comparator 300 further includes connective waveguide air volume 324 connecting output combined branch 208 of magic tee 200A to first side input branch 102 of magic tee 100A.

With the magic tees 100A, 100B, 200A and 200B configured as shown in FIG. 3A, monopulse comparator 300 may include first 302 and third 306 rectangular waveguide antenna inputs facing the +y axis direction. Monopulse comparator 300 may further include second 304 and fourth 308 rectangular waveguide antenna inputs facing the −y axis direction, according to an embodiment of the present invention. As shown in FIG. 3A, monopulse comparator 300 may further include a third 316 rectangular waveguide monopulse output pointing in the +y axis, according to an embodiment of the present invention. Monopulse comparator 300 may further include a first 312 rectangular waveguide monopulse output facing the −y axis direction (not visible in FIG. 3A, but symmetrical to output 316), according to an embodiment of the present invention. Finally, monopulse comparator 300 may further include second 314 and fourth 318 rectangular waveguide monopulse outputs pointing in +z axis direction, according to an embodiment of the present invention.

Figure 3B:
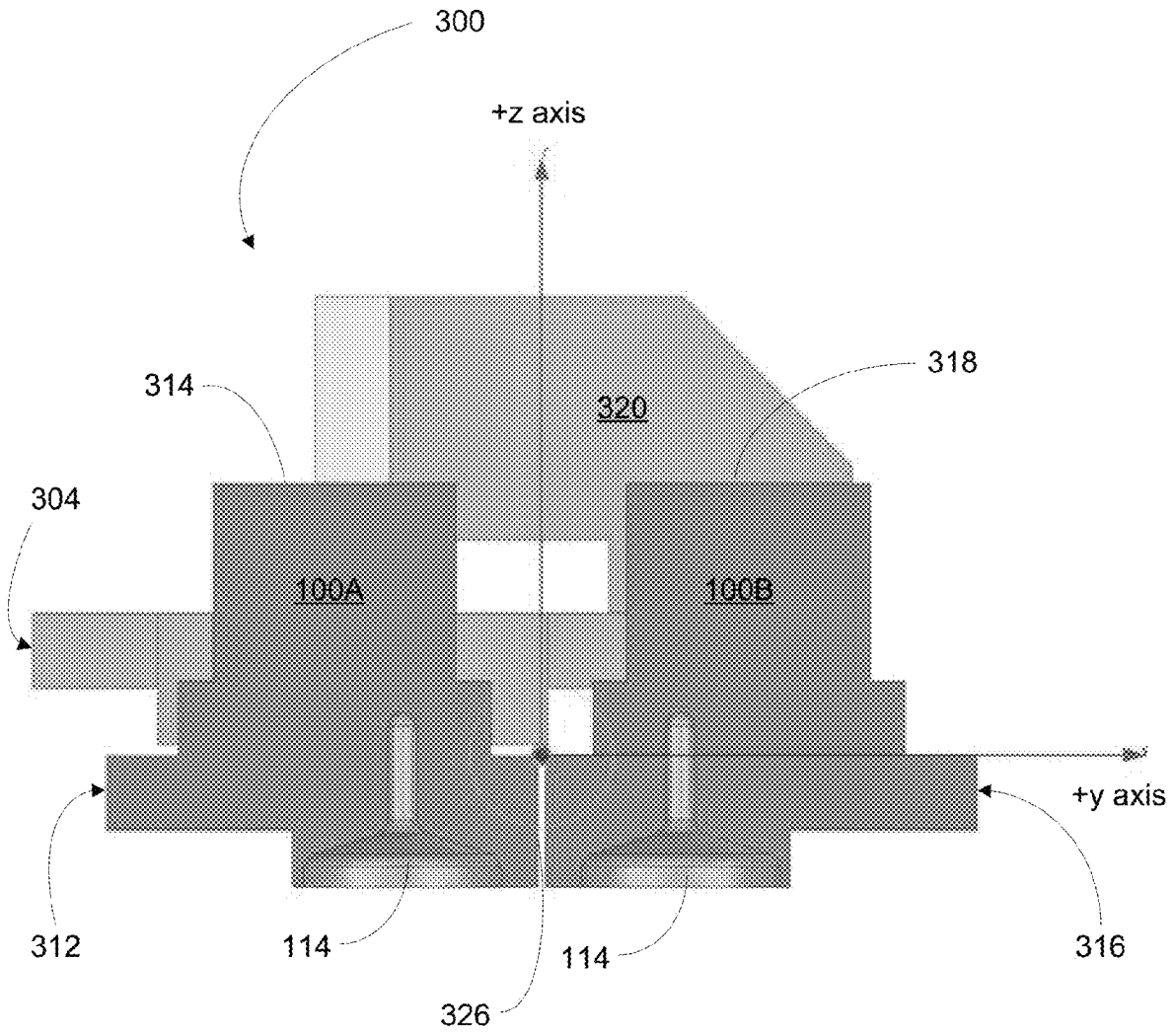
FIG. 3B is a cross-sectional side view of the first embodiment of an integrated monopulse comparator configuration, as shown in FIG. 3A, according to the present invention.

FIG. 3B is a cross-sectional side view of the first embodiment of an integrated monopulse comparator 300, as shown in FIG. 3A, according to the present invention. More particularly, FIG. 3B shows the y-z cut plane through the center of the monopulse comparator 300 and magic tees 100A and 100B, according to the present invention. Monopulse comparator 300 may further include a third rectangular waveguide monopulse output 316 pointing in the +y axis direction. Monopulse comparator 300 may further include a second rectangular waveguide input 304 facing the −y axis direction. FIG. 3B further illustrates a first rectangular waveguide monopulse output 312 pointing in −y axis. Finally, monopulse comparator 300 may further include second 314 and fourth 318 rectangular waveguide monopulse outputs pointing in +z axis. As shown in FIG. 3B, monopulse comparator 300 may further include two internal matching structures 114 and connective waveguide air volume 320. Note further that each magic tee 100A, 100B, 200A and 200B has its own internal matching structure 114, but only two are shown in the FIG. 3B cross-section.

Figure 4A:
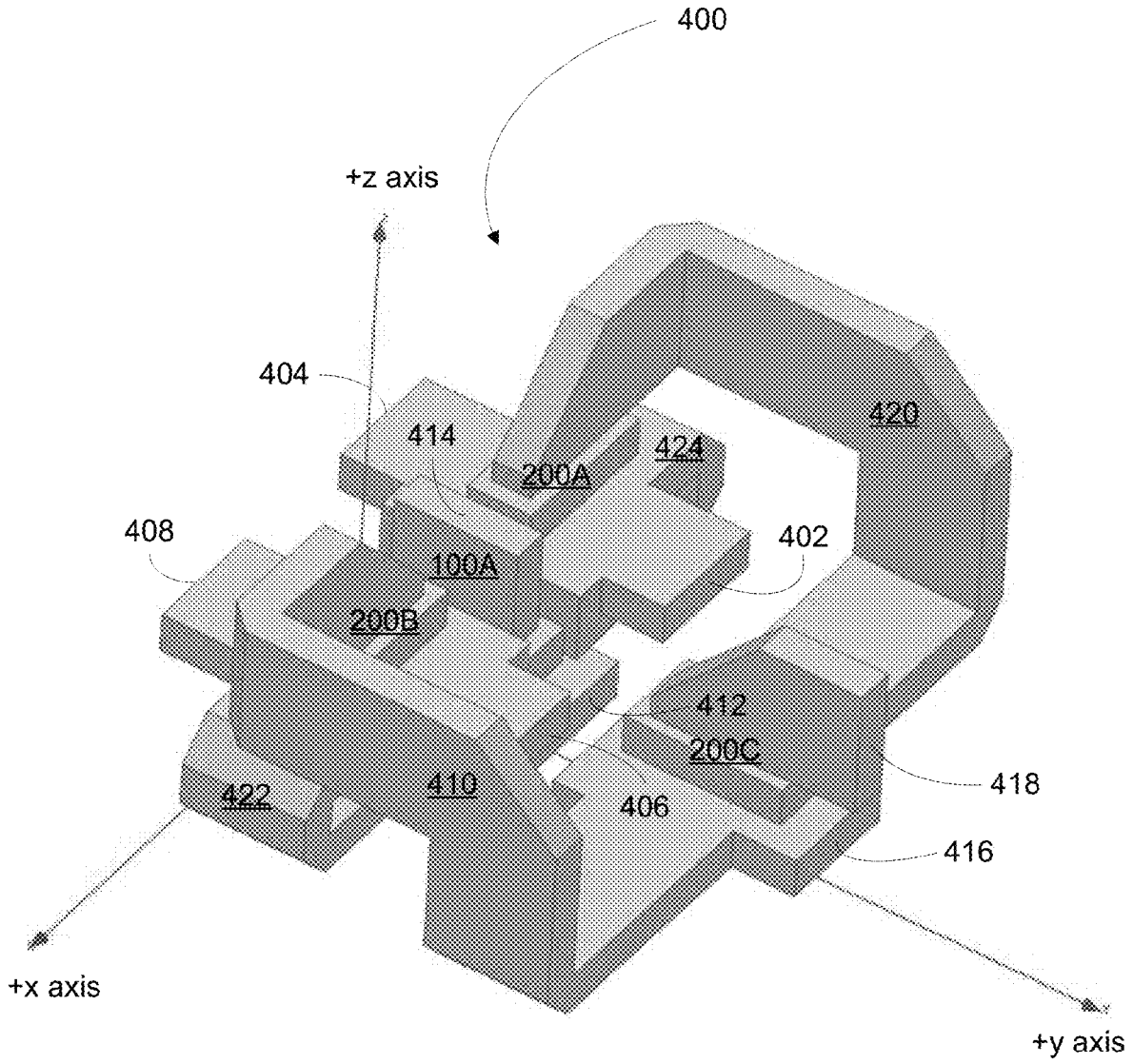
FIG. 4A is an isometric view of a second embodiment of an integrated monopulse comparator configuration, according to the present invention.

FIG. 4A illustrates an isometric perspective view of an air volume of a second embodiment of an integrated monopulse comparator 400, according to the present invention. Monopulse comparator 400 may include magic tee 100A located centrally near the origin and extending parallel to, and in, the +y axis direction. Monopulse comparator 400 may further include magic tees 200A and 200B, symmetrically oriented and surrounding magic tee 100A. Finally, monopulse comparator 400 may further include magic tee 200C spaced apart from magic tee 100A and further along the +y axis direction, as shown in FIG. 4A.

As further shown in FIG. 4A, the second embodiment of a monopulse comparator 400 may further include first 402 and third 406 rectangular waveguide antenna input pointing in the +y axis direction, according to the present invention. The second embodiment of a monopulse comparator 400 may further include second 404 and fourth 408 rectangular waveguide antenna inputs pointing in −y axis direction, according to the present invention. As further shown in FIG. 4A, the second embodiment of a monopulse comparator 400 may further include first 412, third 416, and fourth 418 rectangular waveguide monopulse output facing in the +y axis direction. The second embodiment of a monopulse comparator 400 may further include second rectangular waveguide monopulse output 414 pointing in +z axis direction.

As shown in FIG. 4A, the second embodiment of an integrated monopulse comparator 400 further includes connective waveguide air volume 410 connecting the output difference branch 206 of magic tee 200B to first side input branch 202 of magic tee 200C. Symmetrically, the second embodiment of an integrated monopulse comparator 400 may further includes connective waveguide air volume 420 connecting the output difference branch 206 of magic tee 200A to second side input branch 204 of magic tee 200C. The second embodiment of an integrated monopulse comparator 400 further includes connective waveguide air volume 422 connecting output combined branch 208 of magic tee 200B to first side input branch 102 of magic tee 100A. Symmetrically, the second embodiment of an integrated monopulse comparator 400 further includes connective waveguide air volume 424 connecting output combined branch 208 of magic tee 200A to second side input branch 104 of magic tee 100A.

Figure 4B:
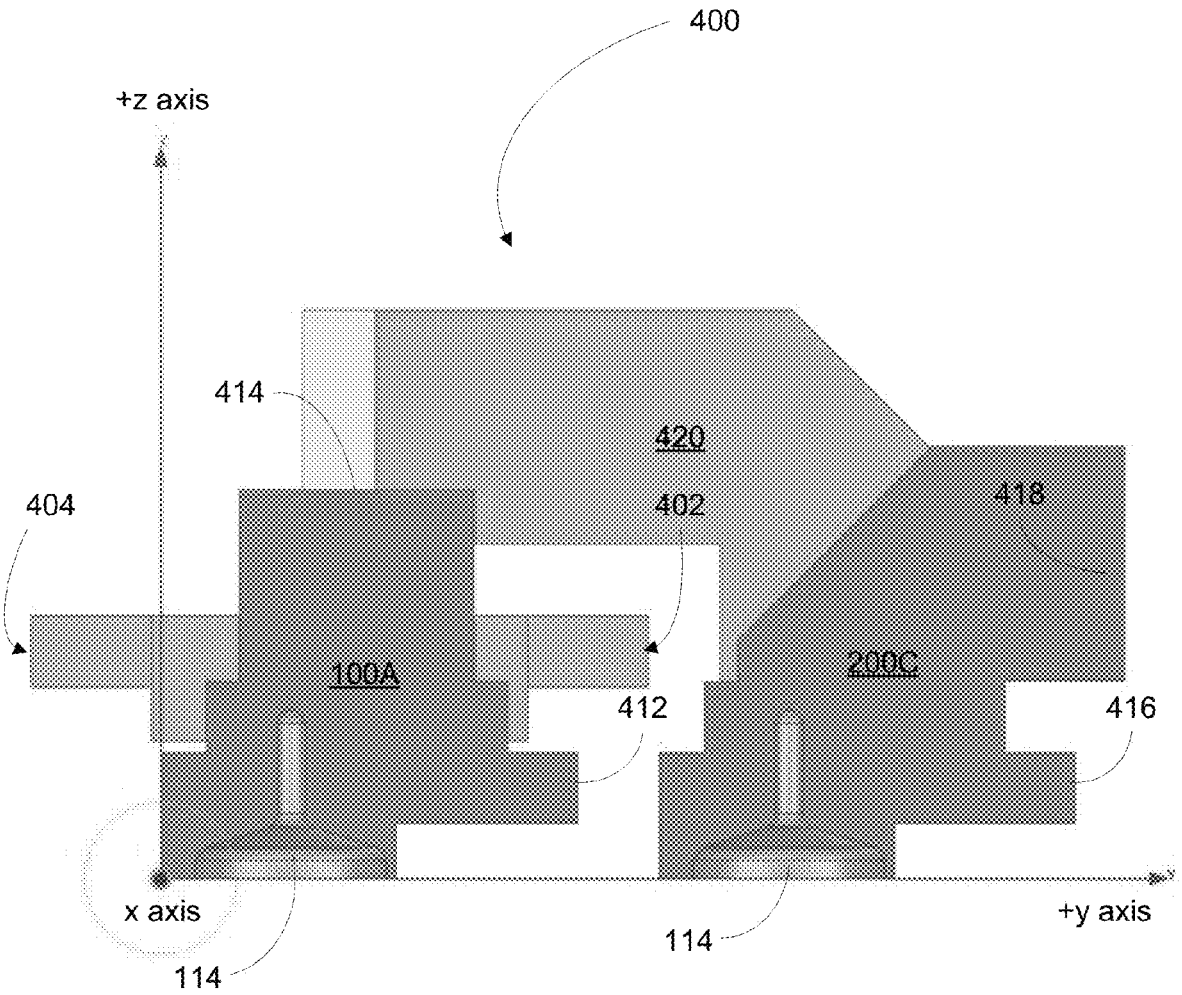
FIG. 4B illustrates a cross-sectional side view of the second embodiment of an integrated monopulse comparator configuration, as shown in FIG. 4A, with y-z cut plane through center, according to the present invention.

FIG. 4B illustrates a cross-sectional side view of the second embodiment of the second integrated monopulse comparator 400, as shown in FIG. 4A, with y-z cut plane through center of the comparator 400, according to the present invention. More particularly as shown in FIG. 4B, the second integrated monopulse comparator 400 may include a first rectangular waveguide antenna input 402 pointing in +y axis direction. The second integrated monopulse comparator 400 may further include second rectangular waveguide antenna input 404 pointing in −y axis direction. The second integrated monopulse comparator 400 may further include first 412, third 416, and fourth 418 rectangular waveguide monopulse outputs pointing in the +y axis direction. Finally, the second integrated monopulse comparator 400 may further include a second rectangular waveguide monopulse output 414 pointing in +z axis direction. FIG. 4B further illustrates two internal matching structures 114 located within magic tees 100A and 200C. FIG. 4B further illustrates connective waveguide air volume 420 connecting the output combined branch 208 of magic tee 200A to second side input branch 202 of magic tee 200C.

Figure 5A:
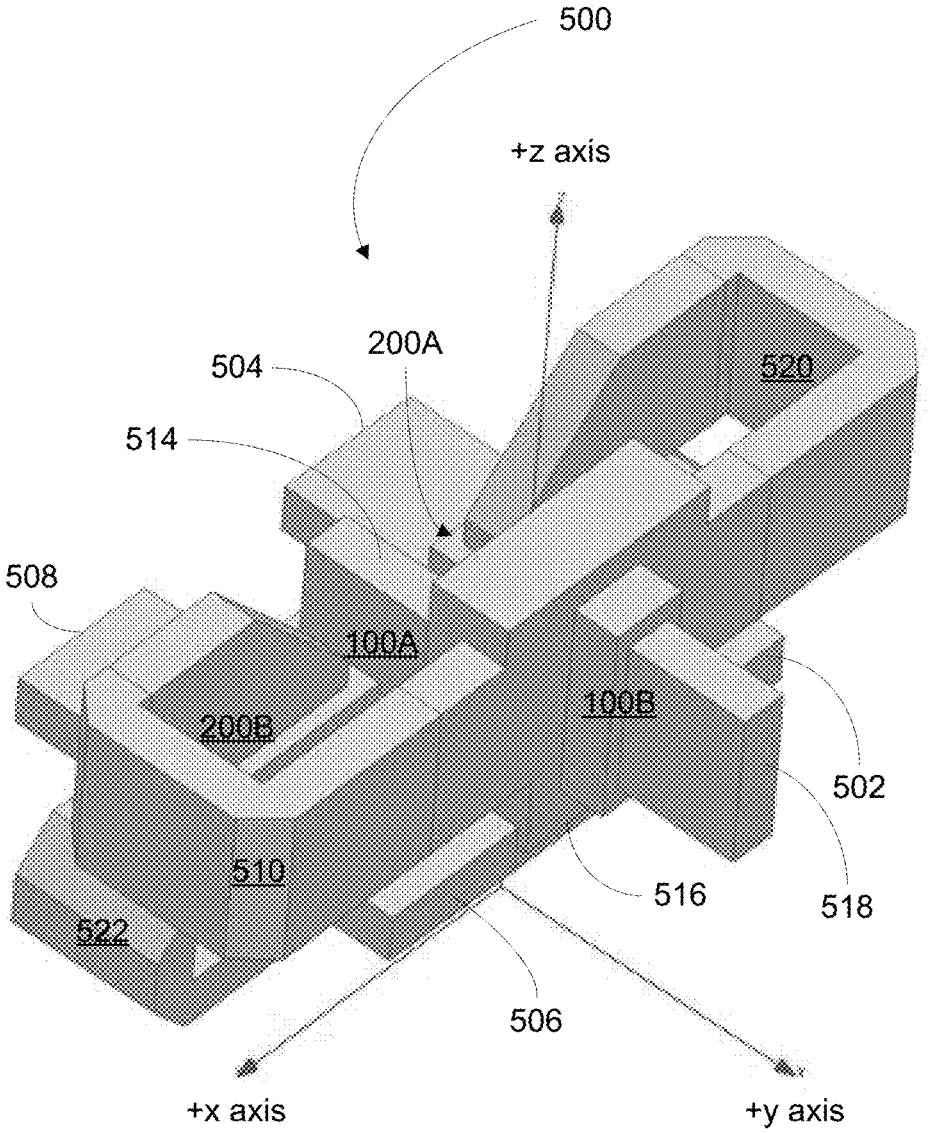
FIG. 5A is an isometric view of a third embodiment of an integrated monopulse comparator configuration, according to the present invention.

FIG. 5A illustrates an isometric perspective view of a third embodiment of an integrated monopulse comparator 500, according to the present invention. Similar to first 300 and second 400 monopulse comparator embodiments, third comparator 500 may be formed from four magic tees 100A, 100B, 200A and 200B and four connective waveguide (air volumes) 510, 520, 522 and 524.

More particularly, a first magic tee 100A may be oriented along the −y axis and sandwiched between symmetrically oriented second 200A and third magic tees 200B. A fourth magic tee 100B may be connected to second 200A and third magic tees 200B via connective waveguides (air volumes) 510 and 520.

As shown in FIG. 5A, the third embodiment of an integrated monopulse comparator 500 further includes connective waveguide air volume 510 connecting the output difference branch 206 of magic tee 200B to first side input branch 102 of magic tee 100B. Symmetrically, the third embodiment of an integrated monopulse comparator 500 may further includes connective waveguide air volume 520 connecting the output difference branch 206 of magic tee 200A to second side input branch 104 of magic tee 100B. Third embodiment of an integrated monopulse comparator 500 may further include connective waveguide air volume 522 connecting output combined branch 208 of magic tee 200B to second side input branch 104 of magic tee 100A. Symmetrically, the third embodiment of an integrated monopulse comparator 500 further includes connective waveguide air volume 524 (not shown in FIG. 5A) connecting output combined branch 208 of magic tee 200A to first side input branch 102 of magic tee 100A.

As further shown in FIG. 5A, the third embodiment of a monopulse comparator 500 may include first 502 and third 506 rectangular waveguide antenna inputs pointing in +y axis direction. As further shown in FIG. 5A, the third embodiment of a monopulse comparator 500 may further include second 504 and fourth 508 rectangular waveguide antenna inputs pointing in −y axis direction. The third embodiment of a monopulse comparator 500 may further include a first rectangular waveguide monopulse output 512 pointing in −y axis direction (hidden in FIG. 5A, however see 512 in FIG. 5B). The third embodiment of a monopulse comparator 500 may further include a third rectangular waveguide monopulse output 516 pointing in the −z axis direction. The third embodiment of a monopulse comparator 500 may further include a second rectangular waveguide monopulse output 514 pointing in +z axis direction. Finally, the third embodiment of a monopulse comparator 500 may further include a fourth rectangular waveguide monopulse output 518 pointing in the +y axis direction.

Figure 5B:
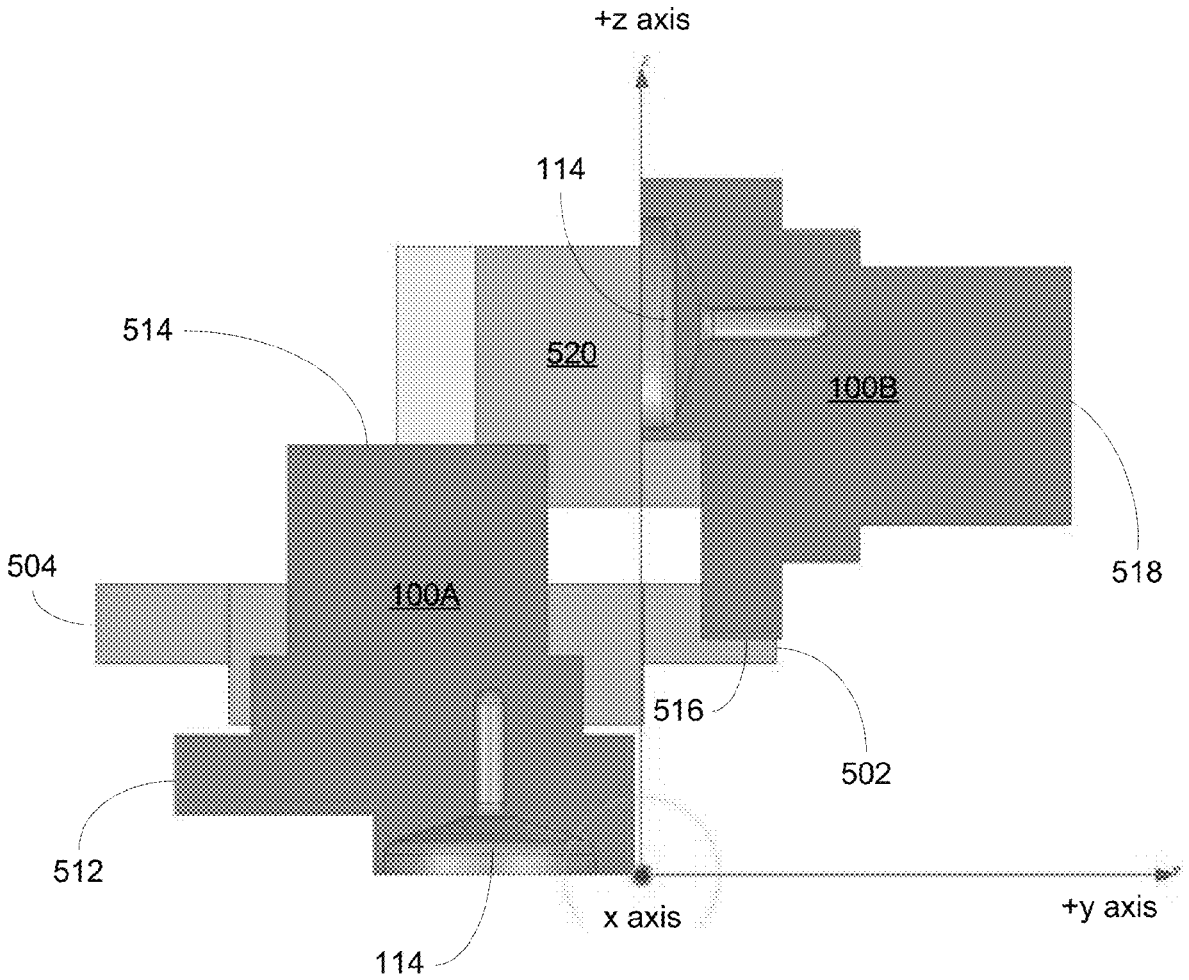
FIG. 5B illustrates a cross-sectional side view of a third embodiment of an integrated monopulse comparator configuration with y-z cut plane through center, according to the present invention.

FIG. 5B illustrates a cross-sectional side view of the third embodiment of an integrated monopulse comparator 500 with y-z cut plane through center, according to the present invention. More particularly, monopulse comparator 500 may include a first rectangular waveguide antenna input 502 pointing in +y axis direction. Monopulse comparator 500 may further include a second rectangular waveguide antenna input 504 pointing in −y axis direction. FIG. 5B further illustrates a first rectangular waveguide monopulse output 512 pointing in −y axis direction. FIG. 5B further illustrates a third rectangular waveguide monopulse output 516 pointing in the −z axis direction. FIG. 5B further illustrates a second rectangular waveguide monopulse output 514 pointing in +z axis direction. FIG. 5B further illustrates a fourth rectangular waveguide monopulse output 518 pointing in the +y axis. Each magic tee 100A and 100B encloses its own internal matching structure 114. Note that magic tees 200A and 200B (not shown in FIG. 5B) also encloses its own internal matching structure 114.

Figure 6A:
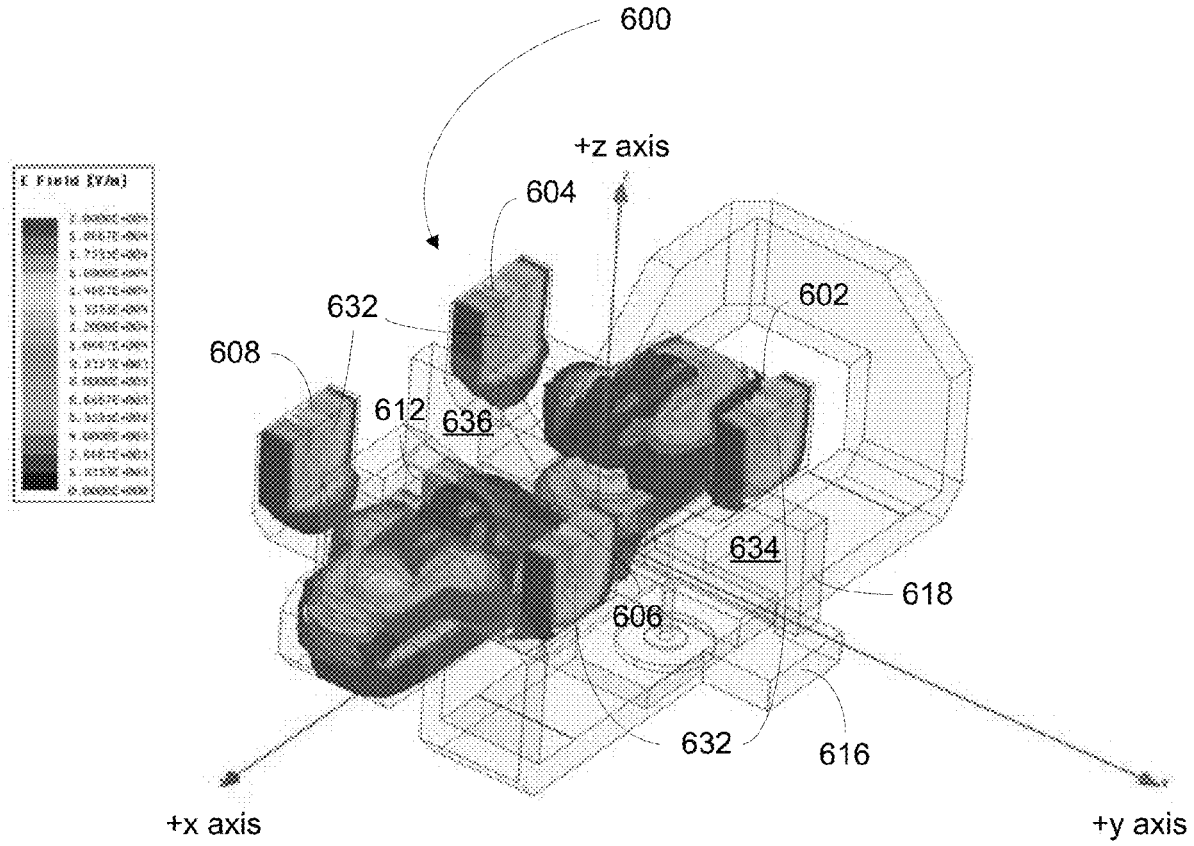
FIG. 6A illustrates a propagating electric field (Combined pattern—Sum), superimposed on an isometric wireframe perspective view of a fourth embodiment of an integrated monopulse comparator, according to the present invention.

FIG. 6A illustrates a radiation pattern (Combined pattern—Sum), superimposed on an isometric wireframe perspective view of a fourth embodiment of an integrated monopulse comparator 600, according to the present invention. Fourth comparator 600 is similar in configuration to comparator 300 shown in FIGS. 3A and 3B. By adding chamfered 90° bending waveguides 632 to direct all four rectangular waveguide inputs 602, 604, 606, 608 to point in the +z axis direction and by adding chamfered 90° bending waveguides 636 and 634 to second 614 and third 616 rectangular waveguide monopulse outputs, respectively, comparator 300 is essentially identical to the fourth embodiment of comparator 600.

More particularly, FIG. 6A illustrates fourth comparator 600 with an electric field source located at first rectangular waveguide monopulse output 612 and resulting propagating electric field (Combined pattern—Sum), according to the present invention. Pointing of the first 602, second 604, third 606, and fourth 608 rectangular waveguide antenna inputs in the +z axis is achieved through a simple chamfered 90° connective waveguide bend 632. Thus, inputs and outputs can be pointed into any favorable direction.

Figure 6B:
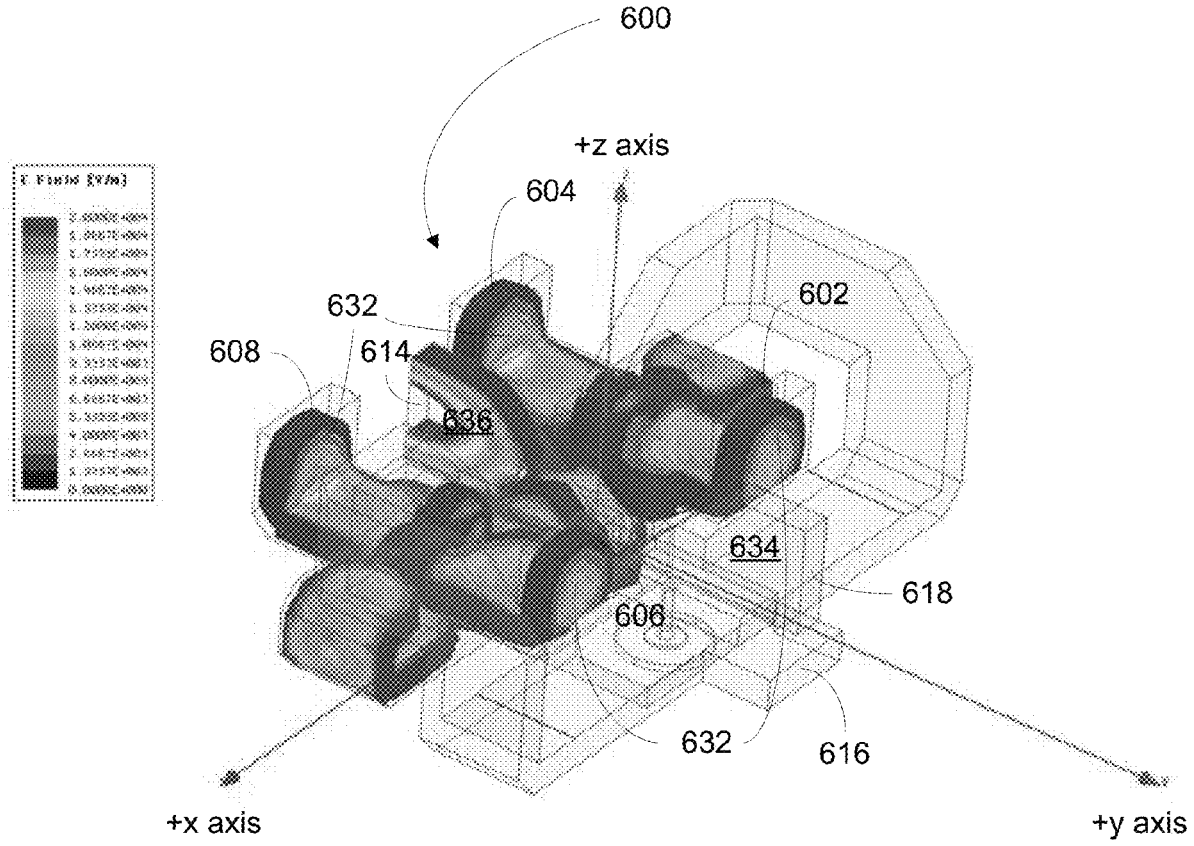
FIG. 6B illustrates another propagating electric field (Difference pattern: Delta), superimposed on isometric perspective view of the fourth embodiment of an integrated monopulse comparator shown in FIG. 6A, according to the present invention.

FIG. 6B illustrates another propagating electric field (Difference pattern: Delta), superimposed on isometric perspective view of the fourth embodiment of an integrated monopulse comparator 600 shown in FIG. 6A, according to the present invention. More particularly, the propagating electric field illustrated in FIG. 6B results from an electric field source at second rectangular waveguide monopulse output 614 of the integrated monopulse comparator 600, according to the present invention. FIG. 6B also shows first 602, second 604, third 606, and fourth 608 rectangular waveguide antenna inputs pointing in +z axis direction. FIG. 6B further illustrates second rectangular waveguide monopulse output 614 pointing in the −y axis direction. FIGS. 6A and 6B also shows third 616 and fourth 618 rectangular waveguide monopulse outputs pointing in the +y axis direction.

Figure 6C:
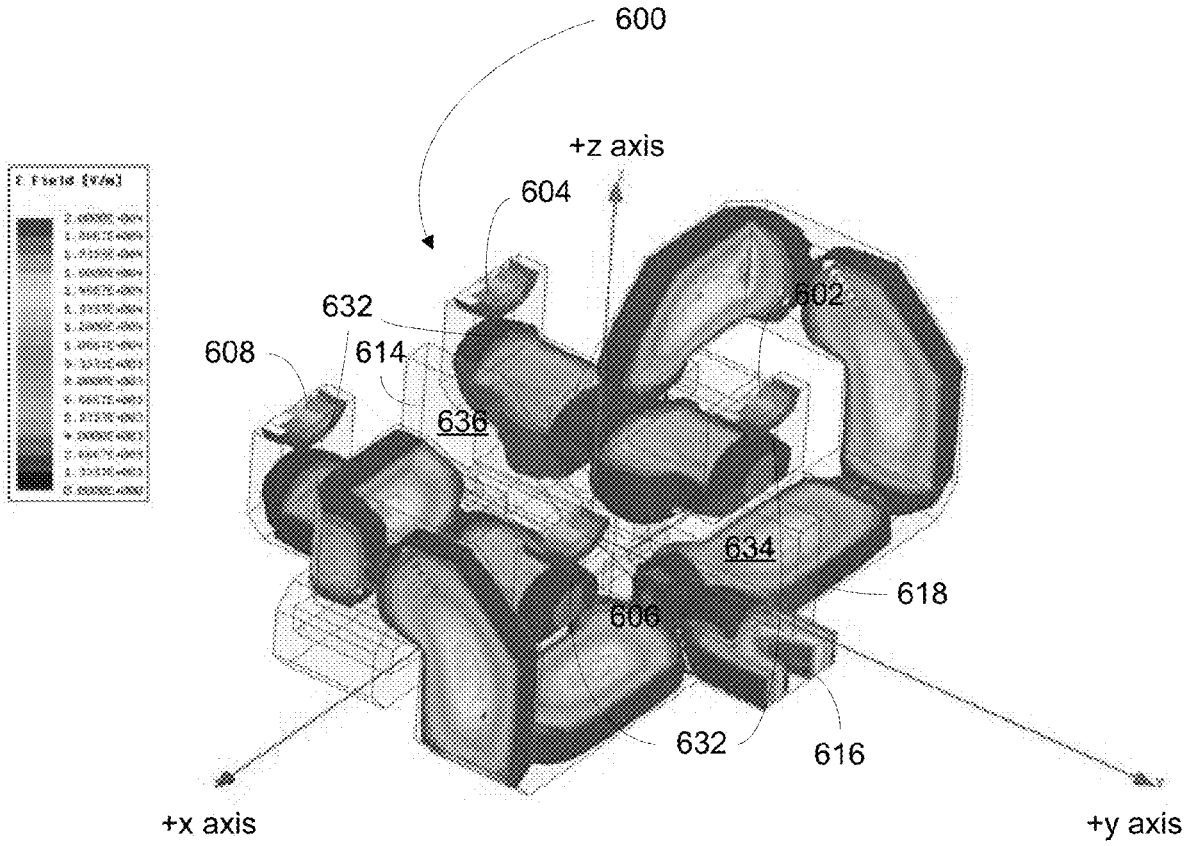
FIG. 6C illustrates yet another propagating electric field (Difference pattern: Delta), superimposed on an isometric perspective view of the fourth embodiment of an integrated monopulse comparator shown in FIGS. 6A and 6B, according to the present invention.

FIG. 6C illustrates yet another propagating electric field (Difference pattern: Delta), superimposed on an isometric perspective view of the fourth embodiment of an integrated monopulse comparator 600, according to the present invention. More particularly, the propagating electric field illustrated in FIG. 6C results from an electric field source located at third rectangular waveguide monopulse output 616, according to the present invention. FIG. 6C also illustrates first 602, second 604, third 606, and fourth 608 rectangular waveguide antenna inputs pointing in the +z axis direction. FIG. 6C further illustrates second rectangular waveguide monopulse output 614 pointing in the −y axis direction. FIG. 6C also shows third 616 and fourth 618 rectangular waveguide monopulse outputs pointing in the +y axis direction.

Figure 6D:
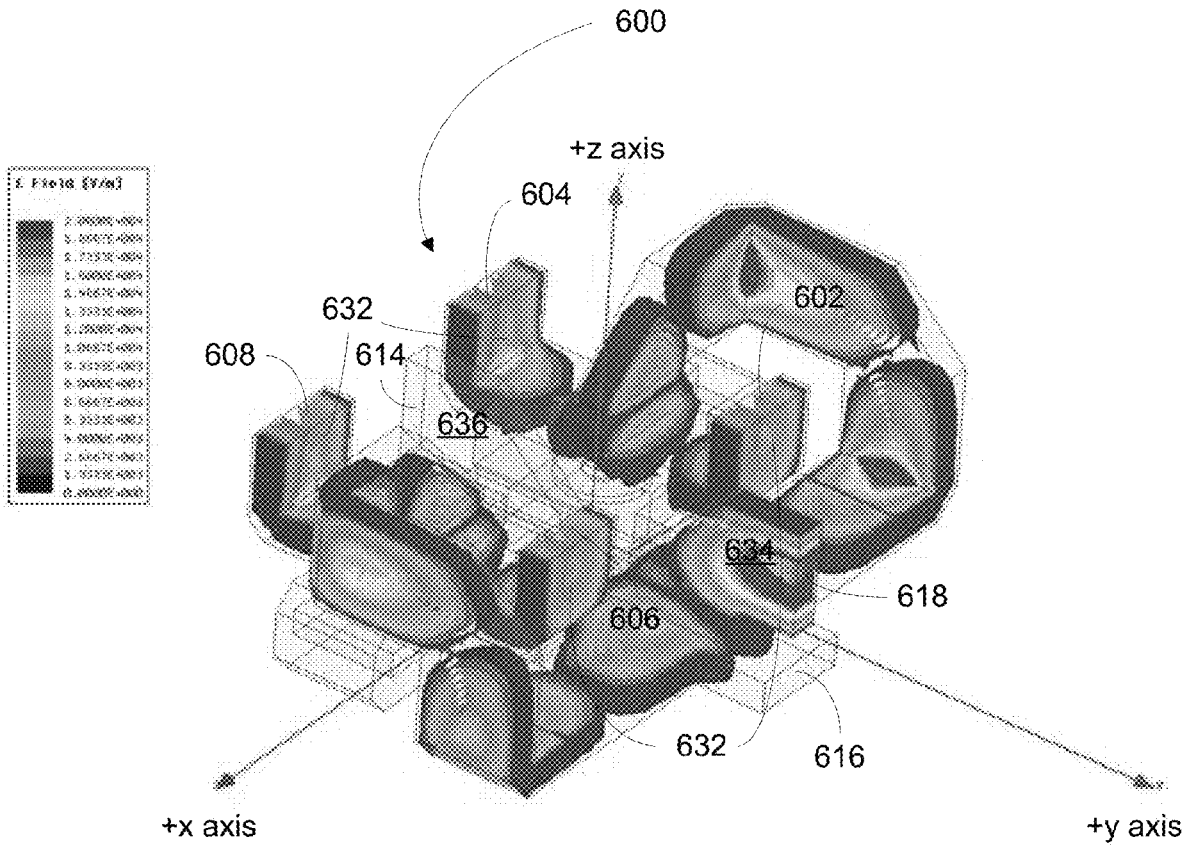
FIG. 6D illustrates still another propagating electric field (Difference pattern: Delta), superimposed on an isometric perspective view of the fourth embodiment of an integrated monopulse comparator FIGS. 6A-6C, according to the present invention.

FIG. 6D illustrates still another propagating electric field (Difference pattern: Delta), superimposed on an isometric perspective view of the fourth embodiment of an integrated monopulse comparator 600, according to the present invention. More particularly, propagating electric field illustrated in FIG. 6D results from an electric field source located at fourth rectangular waveguide monopulse output 618, according to the present invention. FIG. 6D also illustrates first 602, second 604, third 606, and fourth 608 rectangular waveguide antenna inputs pointing in the +z axis direction. FIG. 6D further illustrates second rectangular waveguide monopulse output 614 pointing in the −y axis direction. FIG. 6D also shows third 616 and fourth 618 rectangular waveguide monopulse outputs pointing in the +y axis direction. Note that first rectangular waveguide monopulse output 612 is hidden, or difficult to discern, in FIGS. 6B-6D, but see FIG. 6A.

Figure 7A:
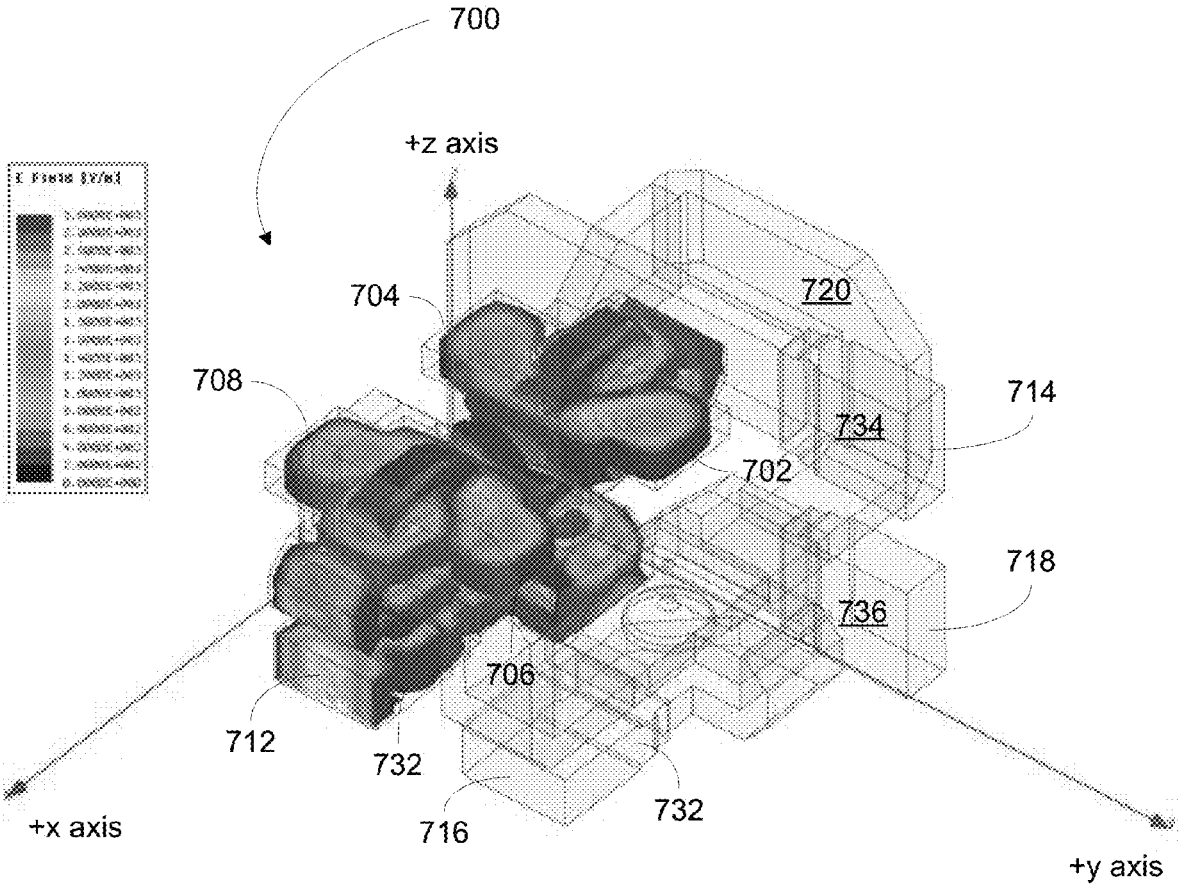
FIG. 7A illustrates a propagating electric field (Combined pattern—Sum) superimposed on an isometric perspective view of a fifth embodiment of an integrated monopulse comparator, according to the present invention.

FIG. 7A illustrates a propagating electric field (Combined pattern—Sum) superimposed on an isometric perspective view of a fifth embodiment of an integrated monopulse comparator 700, according to the present invention. The fifth embodiment of a monopulse comparator 700, is similar in configuration to the second embodiment of a monopulse comparator 400 shown in FIGS. 4A and 4B, with additional bending waveguides to redirect inputs and outputs as shown in FIG. 7A. The propagating electric field illustrated in FIG. 7A results from an electric field source located at a first rectangular waveguide monopulse output 712, according to the present invention.

Figure 7B:
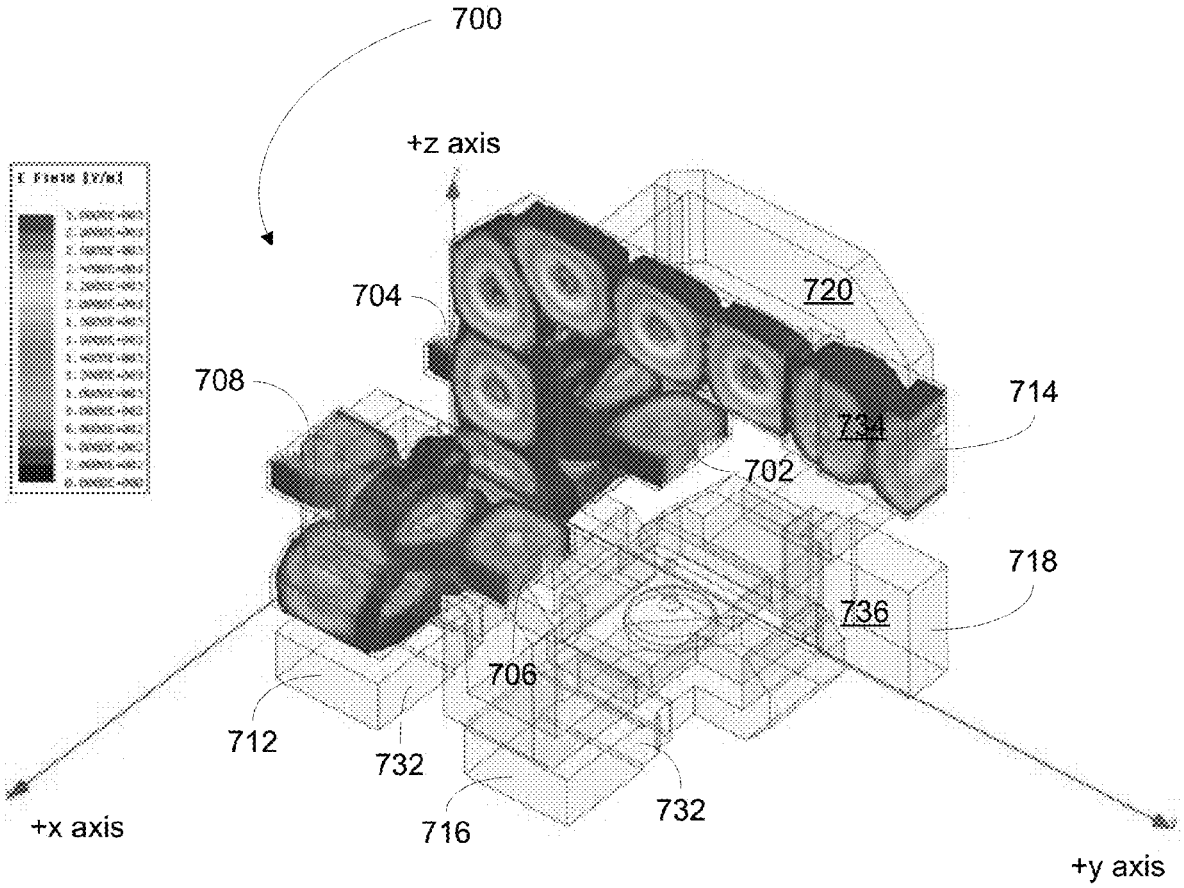
FIG. 7B illustrates another propagating electric field (Difference pattern: Delta) superimposed on an isometric perspective view of the fifth embodiment of the integrated monopulse comparator, as shown in FIG. 7A, according to the present invention.

FIG. 7B illustrates another propagating electric field (Difference pattern: Delta) superimposed on an isometric perspective view of the fifth embodiment of the integrated monopulse comparator 700, as shown in FIG. 7A, according to the present invention. The propagating electric field illustrated in FIG. 7B results from an electric field source located at second rectangular waveguide monopulse output 714, according to the present invention.

Figure 7C:
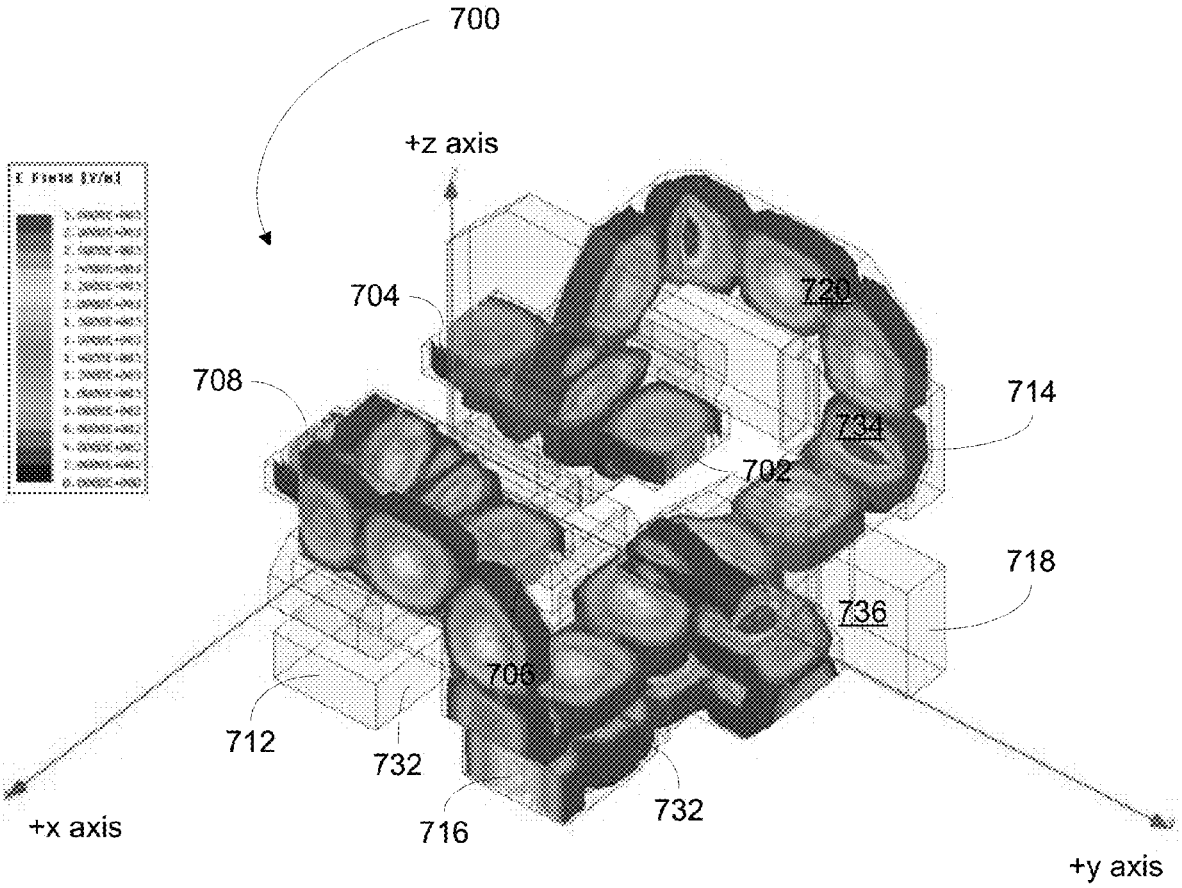
FIG. 7C illustrates yet another propagating electric field (Difference pattern: Delta) superimposed on an isometric perspective view of the fifth embodiment of an integrated monopulse comparator, as shown in FIGS. 7A and 7B, according to the present invention.

FIG. 7C illustrates yet another propagating electric field (Difference pattern: Delta) superimposed on an isometric perspective view of the fifth embodiment of an integrated monopulse comparator 700, as shown in FIGS. 7A and 7B, according to the present invention. The propagating electric field illustrated in FIG. 7C results from an electric field source located at third rectangular waveguide monopulse output 716, according to the present invention.

Figure 7D:
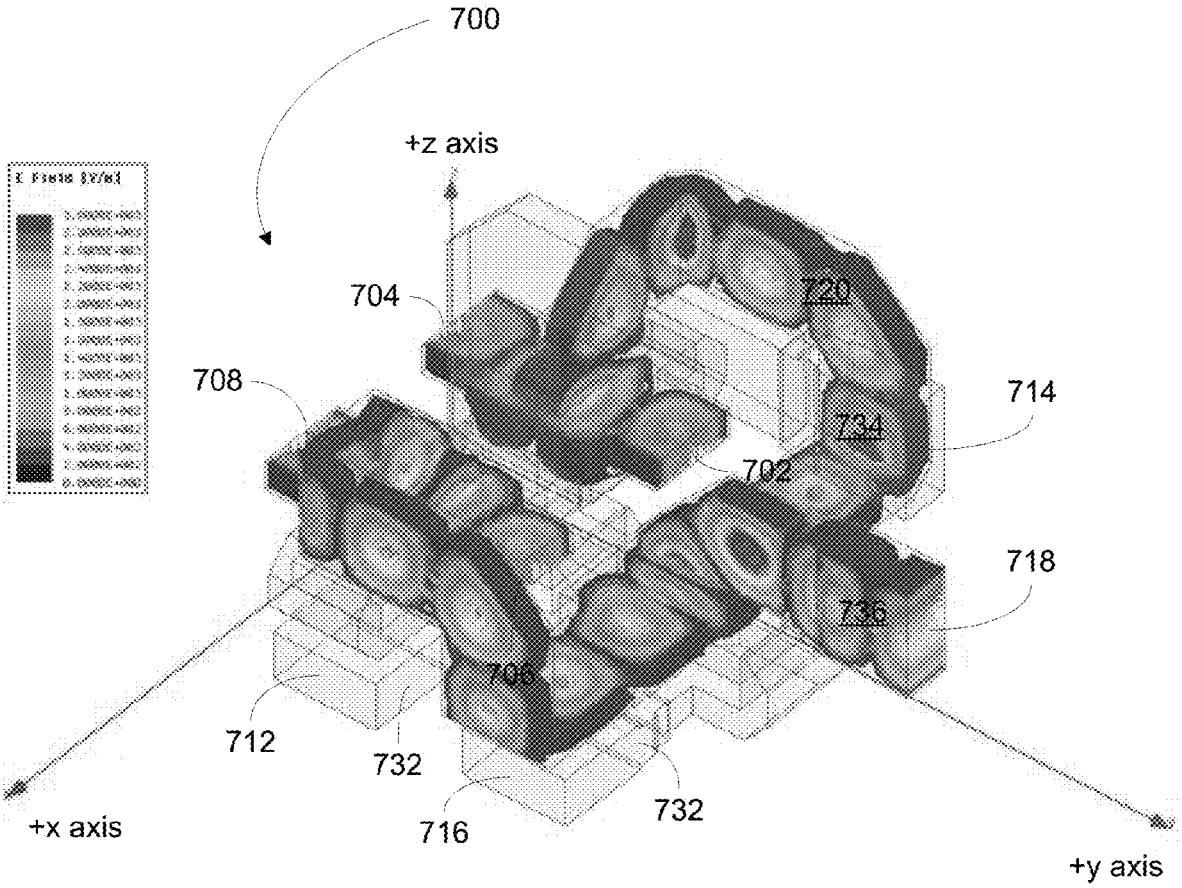
FIG. 7D illustrates still another propagating electric field (Difference pattern: Delta) superimposed on an isometric perspective view of the fifth integrated monopulse comparator, as shown in FIGS. 7A-7C, according to the present invention.

FIG. 7D illustrates still another propagating electric field (Difference pattern: Delta) superimposed on an isometric perspective view of the fifth integrated monopulse comparator 700, as shown in FIGS. 7A-7C, according to the present invention. The propagating electric field illustrated in FIG. 7C results from an electric field source located at fourth rectangular waveguide monopulse output 718, according to the present invention.

More particularly, FIGS. 7A-D illustrate first 702 and third 706 rectangular waveguide antenna inputs pointing in the +y axis direction. FIGS. 7A-D further illustrate second 704 and fourth 708 rectangular waveguide antenna inputs pointing in the −y axis direction. FIGS. 7A-D further illustrate first 712 and third 716 rectangular waveguide monopulse outputs pointing in the +x axis direction. FIGS. 7A-D also show second 714 and fourth 718 rectangular waveguide monopulse outputs pointing in the +y axis direction. Thus, the ports were relocated to a desired location through use of chamfered 90° bending waveguides 732, 734 and 736 and then the waveguide size was changed through matched impedance steps, according to the present invention.

FIG. 8 is an isometric view of a sixth embodiment of an integrated monopulse comparator 800, according to the present invention. The sixth embodiment of an monopulse comparator 800 is similar to the first embodiment of a monopulse comparator 300 illustrated in FIGS. 3A, 3B, 6A, 6B, 6C and 6D, with metal around the air volumes illustrating four input ports 802, 804, 806, 808 and two output ports 814 and 818. Two additional output ports 812 and 816 (not shown in FIG. 8 because they are hidden by the view geometry) are oriented to point down in the opposite direction of 802, 804, 806, and 808. This favorable orientation allows for tight spacing of all required waveguide flanges in the sixth integrated monopulse comparator 800 shown in FIG. 8. Integrated monopulse comparator 800 may be fabricated using metal 3D printing as a single piece.

FIG. 9 is a perspective image of an embodiment of a 4×4 antenna array 900 including an embodiment of an integrated monopulse comparator similar to 300, 600 and 800, as described herein, that has been integrated into lower quarter of the antenna array 900, according to the present invention. What is important to note is that the monopulse comparator embodiments 300, 400, 500, 600, 700 and 800 with their various geometries can be integrated into higher level assemblies, such as the 4×4 array 900. The 4×4 antenna array 900 may include 16 waveguide horns that are divided into 4 quadrants of 4 horns each. Each quadrant is combined from 4 antenna inputs to 1 antenna input. This converts the 16 antenna inputs from the waveguide horns into 4 total antenna inputs that are fed into 602, 604, 606, 608. This complex 4×4 antenna array assembly 900 may be fabricated as a single piece using metal 3D printing.

General aspects of the various embodiments of monopulse comparators are described further below. A first and second rectangular waveguide antenna inputs connect to the two side input branches of a first waveguide magic tee. A third and fourth rectangular waveguide antenna inputs connect to the two side input branches of a second waveguide magic tee. The output combined branch of the first waveguide magic tee connects with a first routed rectangular waveguide connection which connects to one side input branch of a third waveguide magic tee. The output difference branch of the first waveguide magic tee connects with a second routed rectangular waveguide connection which connects to one side input branch of a fourth waveguide magic tee. The output combined branch of the second waveguide magic tee connects with a third routed rectangular waveguide connection which connects to a second side input branch of the third waveguide magic tee. The output difference branch of the second waveguide magic tee connects with a fourth routed rectangular waveguide connection which connects to a second side input branch of the fourth waveguide magic tee. The output combined branch of the third waveguide magic tee connects to a first rectangular waveguide monopulse output. The output difference branch of the third waveguide magic tee connects to a second rectangular waveguide monopulse output. The output combined branch of the fourth waveguide magic tee connects to a third rectangular waveguide monopulse output. The output difference branch of the fourth waveguide magic tee connects to a fourth rectangular waveguide monopulse output.

The first rectangular waveguide monopulse output is a summed combination of the first, second, third, and fourth rectangular waveguide antenna inputs. The second rectangular waveguide monopulse output is a difference combination that is the difference between the summed combination of the first and second rectangular waveguide antenna inputs and the third and fourth rectangular waveguide antenna inputs. The third rectangular waveguide monopulse output is a difference combination that is the difference between the summed combination of the first and third rectangular waveguide antenna inputs and the second and fourth rectangular waveguide antenna inputs. The fourth rectangular waveguide monopulse output is a difference combination that is the difference between the summed combination of the first and fourth rectangular waveguide antenna inputs and the second and third rectangular waveguide antenna inputs.

The rectangular waveguide antenna inputs are located symmetrically about a center point such that they can be routed to the four input quadrants of a monopulse antenna feed or monopulse antenna array. This orientation allows for phase control to the four antenna quadrants in a monopulse antenna.

The rectangular waveguide monopulse outputs can be routed in such a way that they are accessible at the sides or bottom of the integrated waveguide monopulse assembly. The rectangular waveguide monopulse outputs can have a waveguide flange interface, a coaxial interface, or they can connect to additional RF waveguide such as filters, diplexers, switches, or other.

Each of the first, second, third, and fourth waveguide magic tees are designed in such a way that maximizes performance over a wide bandwidth. The side input branches are located in a plane with the combined output branch, with the side input branches in parallel and facing opposite one another and the combined output branch orthogonal to the side input branches in the same plane. The difference output branch is oriented orthogonal to the plane of the side input branches and the combined output branch. An oversized waveguide cavity connects to the side input branches, the combined output branch, and the difference output branch. An impedance-matching waveguide transition exists where the difference output branch connects to the oversized waveguide cavity. The oversized waveguide cavity contains a stepped set of cylindrical posts with 3 different sizes of cylinders, stepping from shortest height with largest radius to longest height with smallest radius. All of the described features act to improve the bandwidth performance of the waveguide magic tee.

The first, second, third, and fourth waveguide magic tees are oriented in such a way that minimizes the total size (volume) of the integrated waveguide monopulse assembly to the smallest physical size possible. The first and second waveguide magic tees are located in the same plane such that their output combined branches face opposite one another, their output difference branches are parallel, their side input branches are oriented symmetrically about two planes (though not necessarily symmetric about a center point at the intersection of those two planes) and a small space exists between the adjacent oversized waveguide cavities of the first and second magic tees. The third and fourth waveguide magic tees are located in a different plane that sits below the plane of the first and second waveguide magic tees. The third and fourth waveguide magic tees are oriented such that their output combined branches face opposite one another and are aligned orthogonal to the direction of the output combined branches of the first and second waveguide magic tee. The third and fourth waveguide magic tee output difference branches are located in the small space between the adjacent oversized waveguide cavities of the first and second waveguide magic tees. The input branches of the third waveguide magic tee are aligned with the output combined branches of the first and second magic tee, which allows for the shortest possible routing rectangular waveguide connection. This accounts for two of the routing rectangular waveguide connections. The input branches of the fourth magic tee are offset from the output difference branches of the first and second waveguide magic tees, and are connected through a pair of routing rectangular waveguide connections. This accounts for the other two routing rectangular waveguide sections.

In some embodiments the third and fourth waveguide magic tee may be oriented such that they are located in a plane below the first and second waveguide magic tees and their output combined branches are pointed in the same direction. The cylindrical posts located inside the oversized waveguide cavities of the magic tees can have different embodiments that include chamfered or rounded edges. Additionally, the cylindrical posts may be comprised of cones with a bottom radius and a top radius. Additionally, the cylindrical posts may contain two or four cylinders, cones, or a combination of these. These features discussed may be used in combination to construct different embodiments of the cylindrical posts, such as one cylinder and one cone, or two cylinders and one cone.

An example embodiment of a monopulse waveguide array is shown with four quadrants of four horns per quadrant which combine into four rectangular waveguide antenna inputs of an integrated monopulse waveguide comparator assembly.

Having described specific embodiments with reference to the drawings and some general features of the unique waveguide structures described above, additional general embodiments of the invention are disclosed below.

An embodiment of a waveguide magic tee enclosing an internal chamber is disclosed. The embodiment of a magic tee may include a top, a back, a front, a first side, a second side and a plane of symmetry dividing the first side from the second side. The embodiment of a magic tee may further include a first side input branch air volume extending from the plane of symmetry to the first side and having a rectangular first side port. The embodiment of a magic tee may further include a second side input branch air volume extending from the plane of symmetry to the second side and having a rectangular second side port. The embodiment of a magic tee may further include an output combined branch air volume extending from the first and second side input branches to the front and having a rectangular combined port. The embodiment of a magic tee may further include an expansion prism air volume extending from the first and second side input branches toward the top. The embodiment of a magic tee may further include an output difference branch air volume extending from the expansion prism air volume to the top and having a rectangular difference port.

Another embodiment of a waveguide magic tee may further include a base expansion prism air volume extending from the bottom and the back and overlapping the first and second side input branch air volumes. According to various embodiments of a waveguide magic tee, the internal chamber may enclose an internal matching structure.

An embodiment of an integrated waveguide monopulse comparator assembly is disclosed. The embodiment of an integrated waveguide monopulse comparator may include first, second, third and fourth magic tees, wherein each of the four magic tees may have the structure and features as described in the previous paragraph. The embodiment of an integrated waveguide monopulse comparator may further include the rectangular difference port of the first magic tee being coupled to the first side port of the fourth magic tee. The embodiment of an integrated waveguide monopulse comparator may further include the rectangular difference port of the second magic tee coupled to the second side port of the fourth magic tee. The embodiment of an integrated waveguide monopulse comparator may further include the rectangular combined port of the first magic tee coupled to the second side port of the third magic tee. The embodiment of an integrated waveguide monopulse comparator may further include the rectangular combined port of the second magic tee coupled to the first side port of the third magic tee.

According to another embodiment, an integrated waveguide monopulse comparator assembly may further include first, second, third and fourth input ports. According to yet another embodiment of a monopulse comparator assembly, the first input port may include the first side port of the second magic tee. According to still another embodiment of a monopulse comparator assembly, the second input port may include the second side port of the second magic tee. According to still yet another embodiment of a monopulse comparator assembly, the third input port may include the second side port of the first magic tee. Finally according to another embodiment of a monopulse comparator assembly, the fourth input port may include the first side port of According to another embodiment, an integrated waveguide monopulse comparator assembly may further include first, second, third and fourth output ports. According to yet another embodiment of a monopulse comparator assembly, the first output port may include the combined port of the third magic tee. According to still another embodiment of a monopulse comparator assembly, the second output port may include the difference port of the third magic tee. According to still yet another embodiment of a monopulse comparator assembly, the third output port may include the combined port of the fourth magic tee. Finally according to another embodiment of a monopulse comparator assembly, the fourth output port may include the difference port of the fourth magic tee.

According to another embodiment of monopulse comparator assembly, the coupling between the coupled ports may include rectangular waveguide with chamfered 90° turns as described herein. According to yet another embodiment of monopulse comparator assembly, each of the four magic tees may enclose an internal chamber. According to a further embodiment of monopulse comparator assembly, each of the internal chambers may enclose an internal matching structure. According to still another embodiment, the monopulse comparator assembly may be fabricated as a single part or as part of a large integrated single part using metal 3D printing.

An embodiment of a 4×4 antenna array is disclosed. The embodiment of a 4×4 antenna array may include four magic tees, each of the magic tees may be configured with the structure and features described above. The embodiment of a 4×4 antenna array may further include an integrated waveguide monopulse comparator assembly comprising the four magic tees, namely the first, second, third and fourth magic tees. The embodiment of a 4×4 antenna array may further include the rectangular difference port of the first magic tee being coupled to the first side port of the fourth magic tee. The embodiment of a 4×4 antenna array may further include the rectangular difference port of the second magic tee being coupled to the second side port of the fourth magic tee. The embodiment of a 4×4 antenna array may further include the rectangular combined port of the first magic tee being coupled to the second side port of the third magic tee. The embodiment of a 4×4 antenna array may further include the rectangular combined port of the second magic tee being coupled to the first side port of the third magic tee.

According to another embodiment of a 4×4 antenna array, the monopulse comparator assembly may further include first, second, third and fourth input ports. According to yet another embodiment of a 4×4 antenna array, the first input port may include the first side port of the second magic tee. According to still another embodiment of a 4×4 antenna array, the second input port may include the second side port of the second magic tee. According to still yet another embodiment of a 4×4 antenna array, the third input port may include the second side port of the first magic tee. Finally, according to one embodiment of a 4×4 antenna array, the fourth input port may include the first side port of the first magic tee.

According to one embodiment of a 4×4 antenna array, the monopulse comparator assembly may further include first, second, third and fourth output ports. According to one embodiment of a 4×4 antenna array, the first output port may include the combined port of the third magic tee. According to yet another embodiment of a 4×4 antenna array, the second output port may include the difference port of the third magic tee. According to still yet another embodiment of a 4×4 antenna array, the third output port may include the combined port of the fourth magic tee. Finally according to an embodiment of a 4×4 antenna array, the fourth output port may include the difference port of the fourth magic tee.

According to another embodiment of a 4×4 antenna array, the coupling between the coupled ports may include rectangular waveguide with chamfered 90° turns. According to yet another embodiment of a 4×4 antenna array, each of the four magic tees may enclose an inner chamber and each of the inner chambers may enclose an internal matching structure. According to still another embodiment, the 4×4 antenna array, may be fabricated as a single part using metal 3D printing.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. A waveguide magic tee enclosing an internal chamber, comprising:

a top;

a back;

a front;

a first side;

a second side;

a plane of symmetry dividing the first side from the second side;

a first side input branch air volume extending from the plane of symmetry to the first side and having a rectangular first side port;

a second side input branch air volume extending from the plane of symmetry to the second side and having a rectangular second side port;

an output combined branch air volume extending from the first and second side input branches to the front and having a rectangular combined port;

an expansion prism air volume extending from the first and second side input branches toward the top;

an output difference branch air volume extending from the expansion prism air volume to the top and having a rectangular difference port; and a base expansion prism air volume extending from the bottom and the back and overlapping the first and second side input branch air volumes.

2. The waveguide magic tee according to claim 1, wherein the internal chamber encloses an internal matching structure.

3. An integrated waveguide monopulse comparator assembly, comprising:

first, second, third and fourth magic tees, each of the four magic tees according to claim 1, the rectangular difference port of the first magic tee coupled to the first side port of the fourth magic tee;

the rectangular difference port of the second magic tee coupled to the second side port of the fourth magic tee;

the rectangular combined port of the first magic tee coupled to the second side port of the third magic tee; and the rectangular combined port of the second magic tee coupled to the first side port of the third magic tee.

4. The monopulse comparator assembly according to claim 3, wherein the coupling between each of the coupled ports comprises rectangular waveguide with chamfered 90° turns.

5. The monopulse comparator assembly according to claim 3, further comprising first, second, third and fourth input ports.

6. The monopulse comparator assembly according to claim 5, wherein the first input port comprises the first side port of the second magic tee;

wherein the second input port comprises the second side port of the second magic tee;

wherein the third input port comprises the second side port of the first magic tee; and wherein the fourth input port comprises the first side port of the first magic tee.

7. The monopulse comparator assembly according to claim 3, further comprising first, second, third and fourth output ports.

8. The monopulse comparator assembly according to claim 7, wherein the first output port comprises the combined port of the third magic tee;

wherein the second output port comprises the difference port of the third magic tee;

wherein the third output port comprises the combined port of the fourth magic tee; and wherein the fourth output port comprises the difference port of the fourth magic tee.

9. The monopulse comparator assembly according to claim 3, wherein the assembly is fabricated as a single part or as part of a large integrated single part using metal 3D printing.

10. The monopulse comparator assembly according to claim 3, wherein each of the four magic tees encloses an internal chamber.

11. The monopulse comparator assembly according to claim 10, wherein each of the internal chambers encloses an internal matching structure.

12. A 4×4 antenna array, comprising:

four magic tees, each magic tee comprising:

a top;

a back;

a front;

a first side;

a second side;

a plane of symmetry dividing the first side from the second side;

a first side input branch air volume extending from the plane of symmetry to the first side and having a rectangular first side port;

a second side input branch air volume extending from the plane of symmetry to the second side and having a rectangular second side port;

an output combined branch air volume extending from the first and second side input branches to the front and having a rectangular combined port;

an expansion prism air volume extending from the first and second side input branches toward the top; and an output difference branch air volume extending from the expansion prism air volume to the top and having a rectangular difference port; and an integrated waveguide monopulse comparator assembly comprising the four magic tees, namely the first, second, third and fourth magic tees;

wherein the rectangular difference port of the first magic tee is coupled to the first side port of the fourth magic tee;

wherein the rectangular difference port of the second magic tee is coupled to the second side port of the fourth magic tee;

wherein the rectangular combined port of the first magic tee is coupled to the second side port of the third magic tee; and wherein the rectangular combined port of the second magic tee is coupled to the first side port of the third magic tee.

13. The 4×4 antenna array according to claim 12, wherein the array is fabricated as a single part using metal 3D printing.

14. The 4×4 antenna array according to claim 12, wherein the monopulse comparator assembly further comprises first, second, third and fourth input ports.

15. The 4×4 antenna array according to claim 14, wherein the first input port comprises the first side port of the second magic tee;

wherein the second input port comprises the second side port of the second magic tee;

wherein the third input port comprises the second side port of the first magic tee; and wherein the fourth input port comprises the first side port of the first magic tee.

16. The 4×4 antenna array according to claim 12, wherein the monopulse comparator assembly further comprises first, second, third and fourth output ports.

17. The 4×4 antenna array according to claim 16, wherein the first output port comprises the combined port of the third magic tee;

wherein the second output port comprises the difference port of the third magic tee;

wherein the third output port comprises the combined port of the fourth magic tee; and wherein the fourth output port comprises the difference port of the fourth magic tee.

18. The 4×4 antenna array according to claim 12, wherein the coupling between each of the coupled ports comprises rectangular waveguide with chamfered 90° turns.

19. The 4×4 antenna array according to claim 12, wherein each of the four magic tees encloses an inner chamber and each of the inner chambers encloses an internal matching structure.

* * * * *